US007222374B2

(12) United States Patent
Musal et al.

(10) Patent No.: US 7,222,374 B2
(45) Date of Patent: May 29, 2007

(54) HEAD GEAR FITTING SYSTEM

(75) Inventors: Michael J. Musal, Soquel, CA (US); Hilgard N. Muller, Felton, CA (US)

(73) Assignee: Bell Sports, Inc., Irving, TX (US)

( * ) Notice: Subject to any disclaimer, the term of this patent is extended or adjusted under 35 U.S.C. 154(b) by 287 days.

(21) Appl. No.: 10/856,423

(22) Filed: May 26, 2004

(65) Prior Publication Data

US 2005/0262619 A1 Dec. 1, 2005

(51) Int. Cl.
*A42B 7/00* (2006.01)

(52) U.S. Cl. ..... 2/421; 2/417; 24/68 B; 24/274 WB

(58) Field of Classification Search ..... 2/414, 2/415, 416, 417, 418, 419, 420, 421, DIG. 11, 2/181, 181.2, 181.4, 181.8; 24/68 B, 274 WB; 74/422

See application file for complete search history.

(56) References Cited

U.S. PATENT DOCUMENTS 674,213 A * 5/1901 Oldfield ..... 74/422
1,213,800 A * 1/1917 Piper ..... 254/294
1,434,745 A * 11/1922 MacLeod ..... 2/181.4
2,270,149 A * 1/1942 Svensson ..... 2/181
2,463,771 A * 3/1949 Hunz ..... 74/575
2,905,017 A * 9/1959 Randolph ..... 74/489
3,329,968 A * 7/1967 Gordon ..... 2/418
3,500,474 A * 3/1970 Austin ..... 2/418
4,081,865 A 4/1978 Bergee et al. ..... 2/425
4,115,874 A 9/1978 Hasegawa ..... 2/425
4,888,831 A * 12/1989 Oleson ..... 2/420
5,007,141 A 4/1991 Gentes ..... 24/163 R
5,088,130 A 2/1992 Chiarella ..... 2/411
5,093,937 A 3/1992 Kamata ..... 2/424
5,093,938 A 3/1992 Kamata ..... 2/424

(Continued)

FOREIGN PATENT DOCUMENTS

EP 0 517 091 12/1992

(Continued)

OTHER PUBLICATIONS

Notification of Transmittal of International Search Report, mailed Oct. 17, 2005, regarding International Application No. PCT/US2005/253718.0—2314, 3 pages.

*Primary Examiner*—Rodney Lindsey
(74) *Attorney, Agent, or Firm*—Baker Botts L.L.P.

(57) ABSTRACT

According to one embodiment of the invention, a fitting system for a helmet is provided. The fitting system includes a belt having supported racks coupled to a belt adjustment device. The belt adjustment device is operable to allow a user to tighten the belt, and release the belt at a single touch of a release actuator. The belt adjustment device and the racks are configured to hug the occiput of a user when the helmet is properly worn. The belt adjustment device is also operable to hold the rear straps of the helmet apart but is not attached to the helmet. The belt defines a collapsible button for securing a pad. The pad defines a substantially lateral compressed strip that is operable to urge the pad against the belt. The belt adjustment device and the belt are configured to allow rear straps of the helmet to approximately directly approach the chin of the user.

23 Claims, 17 Drawing Sheets

U.S. PATENT DOCUMENTS

| | | | | | |
|---|---|---|---|---|---|
| 5,099,523 | A | | 3/1992 | Broersma | 2/411 |
| 5,119,516 | A | | 6/1992 | Broersma | 2/411 |
| 5,231,703 | A | | 8/1993 | Garneau | 2/414 |
| 5,269,025 | A | | 12/1993 | Broersma | 2/411 |
| 5,309,576 | A | | 5/1994 | Broersma | 2/412 |
| 5,351,341 | A | | 10/1994 | Broersma | 2/412 |
| 5,351,342 | A | | 10/1994 | Garneau | 2/414 |
| 5,357,654 | A | * | 10/1994 | Hsing-Chi | 24/68 B |
| 5,469,583 | A | | 11/1995 | Akeley et al. | 2/421 |
| 5,477,563 | A | | 12/1995 | Gentes et al. | 2/411 |
| 5,481,762 | A | | 1/1996 | Gentes et al. | 2/411 |
| 5,551,094 | A | * | 9/1996 | Navone | 2/421 |
| 5,608,917 | A | * | 3/1997 | Landis et al. | 2/418 |
| 5,659,900 | A | | 8/1997 | Arney et al. | 2/417 |
| 5,675,843 | A | | 10/1997 | Grim et al. | 2/422 |
| 5,729,877 | A | | 3/1998 | Kong et al. | 24/625 |
| 5,774,901 | A | | 7/1998 | Minami | 2/421 |
| 5,833,796 | A | | 11/1998 | Matich | 156/285 |
| 5,867,840 | A | | 2/1999 | Hirosawa et al. | 2/414 |
| 5,887,288 | A | | 3/1999 | Arney et al. | 2/421 |
| 5,896,586 | A | * | 4/1999 | Freund | 2/418 |
| 5,983,405 | A | * | 11/1999 | Casale | 2/421 |
| 6,009,561 | A | | 1/2000 | Bullock et al. | 2/422 |
| 6,009,562 | A | | 1/2000 | Bullock et al. | 2/422 |
| 6,314,588 | B1 | * | 11/2001 | Fang | 2/418 |
| 6,332,227 | B1 | * | 12/2001 | Fang | 2/418 |
| 6,401,261 | B1 | | 6/2002 | Arney et al. | 2/421 |
| 6,421,840 | B1 | | 7/2002 | Chen et al. | 2/410 |
| 6,446,270 | B1 | | 9/2002 | Durr | 2/412 |
| 6,449,776 | B1 | | 9/2002 | Musal | 2/418 |
| 6,457,210 | B1 | * | 10/2002 | Shirai et al. | 24/16 PB |
| 6,481,019 | B2 | * | 11/2002 | Diaz et al. | 2/171.3 |
| 6,711,751 | B1 | | 3/2004 | Muskovitz | 2/410 |
| 2002/0124298 | A1 | | 9/2002 | Muskovitz | 2/410 |

FOREIGN PATENT DOCUMENTS

| | | |
|---|---|---|
| JP | 10-130939 | 8/1998 |
| WO | WO 91/13560 | 9/1991 |
| WO | WO 2004/006706 | 1/2004 |

* cited by examiner

HEAD GEAR FITTING SYSTEM

TECHNICAL FIELD OF THE INVENTION

This invention relates generally to head gear and more particularly to a head gear fitting system.

BACKGROUND OF THE INVENTION

A physical impact to the head of a person may cause serious injury or death. To reduce the probability of such consequences, head protection gear, such as a helmet, is often used in activities that are associated with an increased level of risk for a head injury. Examples of such activities include, but are not limited to, bicycling, rollerblading, rock climbing, skate boarding, skiing, and motorcycling.

The ability of a helmet to protect the head depends at least in part on the proper fitting of the helmet on a person's head. To accommodate different head sizes and head shapes of the general population, a helmet typically has a fitting mechanism, which includes adjustable straps that hold the helmet on the user's head and a belt that conforms to the circumference of the user's head. The effectiveness of the fitting mechanism to achieve a proper fit on a user's head, as well as the associated level of convenience and comfort, affect the helmet's ability to provide head protection to a user.

SUMMARY OF THE INVENTION

According to one embodiment of the invention, a system for fitting a helmet on a head of a user is provided. The helmet has a first strap and a second strap anchored at a rear portion of the helmet. The system includes a belt disposed at least partly in an interior of the helmet The belt has a first curved rack gear and a second curved rack gear that extend toward the rear portion of the helmet. Each of the curved rack gears has a side that is attached to a curved flange and a radius of curvature of approximately 16 inches. The belt defines a first hole and a second hole. The system also includes a rib positioned across the first hole of the belt. The system also includes a button suspended over the second hole of the belt by at least one collapsible leg coupling the button and the belt. The button has a footprint that fits within the second hole. The system also includes a belt adjustment mechanism not directly attached to the helmet. The belt adjustment mechanism comprises a pinion gear engaged with the first and the second curved rack gears of the belt. The belt adjustment mechanism also comprises a wheel gear coaxially attached to the pinion gear, a ratchet engaged with the wheel gear, and a release actuator coupled to the ratchet and positioned in a location separate from the wheel gear. A first end of the belt adjustment mechanism is slidably coupled to the first strap, and a second end of the belt adjustment mechanism positioned approximately 130-140 millimeters from the first end is slidably coupled to the second strap. The wheel gear of the belt adjustment mechanism is operable to incrementally urge the first and the second curved rack gears in opposite directions using the pinion gear by turning in a first direction. The ratchet is operable to prevent the wheel gear from turning in a second direction that is opposite from the first direction. The release actuator is operable to disengage the ratchet from the wheel. The system also includes a pad defining a button hole, an compressed arcuated strip and a compressed strip having an approximately same orientation and width as the rib. The pad is coupled to the button of the belt at the button hole and woven through the first hole and the rib of the belt. The compressed strip of the pad underlies the rib, and the compressed arcuated strip is disposed approximately along the length of the pad.

Some embodiments of the invention may provide the following technical advantages. Other embodiments may realize some, none, or all of these advantages. For example, according to certain embodiments, a belt adjustment apparatus having a ratcheted adjuster on one side and a release mechanism on an opposite side allows a user to adjust the size of the belt using one finger and also allows the user to release the ratcheted adjuster using one touch of the release mechanism. Thus, a user may benefit from quickly and conveniently tightening and/or loosening the belt of a helmet.

In particular embodiments, end portions of a belt having gear teeth for use in the belt adjustment apparatus are supported by a flange formed beside the gear teeth. Such a flange allows the gear teeth to be manufactured from a softer and more flexible material without sacrificing the integrity of the gear teeth. Thus, in an embodiment where the gear teeth are manufactured using the same material as the belt, a softer, more flexible material may be used to manufacture the belt, thus increasing the level of comfort offered to a user. In certain embodiments, the end portion of the belt may have a curvature curving away from the helmet that allows the belt to engage the underside of the back of a user's head, which provides a more secure placement of the helmet on the user's head.

Furthermore, certain embodiment include belts featuring a collapsible button suspended over a hole in the belt that allows a padding material to be attached to the belt in a secure manner without creating a point load source on the head of the user. Such a button thus contributes to the comfort level and safety offered to the user.

In addition, particular embodiments include a pad having compressed strips that are oriented to receive a particular rib of a particular hole allows the pad to better conform to the shape of the belt. Further, a compressed strip that is formed along the length of the pad in certain locations allows the pad to bow out, which allows the pad to better conform to the contour of the belt of the helmet.

Furthermore, in certain embodiments, the rear straps of the helmet are threaded through a rear portion of the belt system to reduce the probability of entangling the rear straps, thus making it easier to use the helmet. Further, in certain embodiments, the rear portion of the belt system is not directly attached to the helmet, which simplifies the process of meeting the safety standards that are imposed on helmets provided to the public.

Other advantages may be readily ascertainable by those skilled in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF EXAMPLE EMBODIMENTS OF THE INVENTION

Embodiments of the invention are best understood by referring to FIGS. 1-9C of the drawings, like numerals being used for like and corresponding parts of the various drawings.

Figure 1:
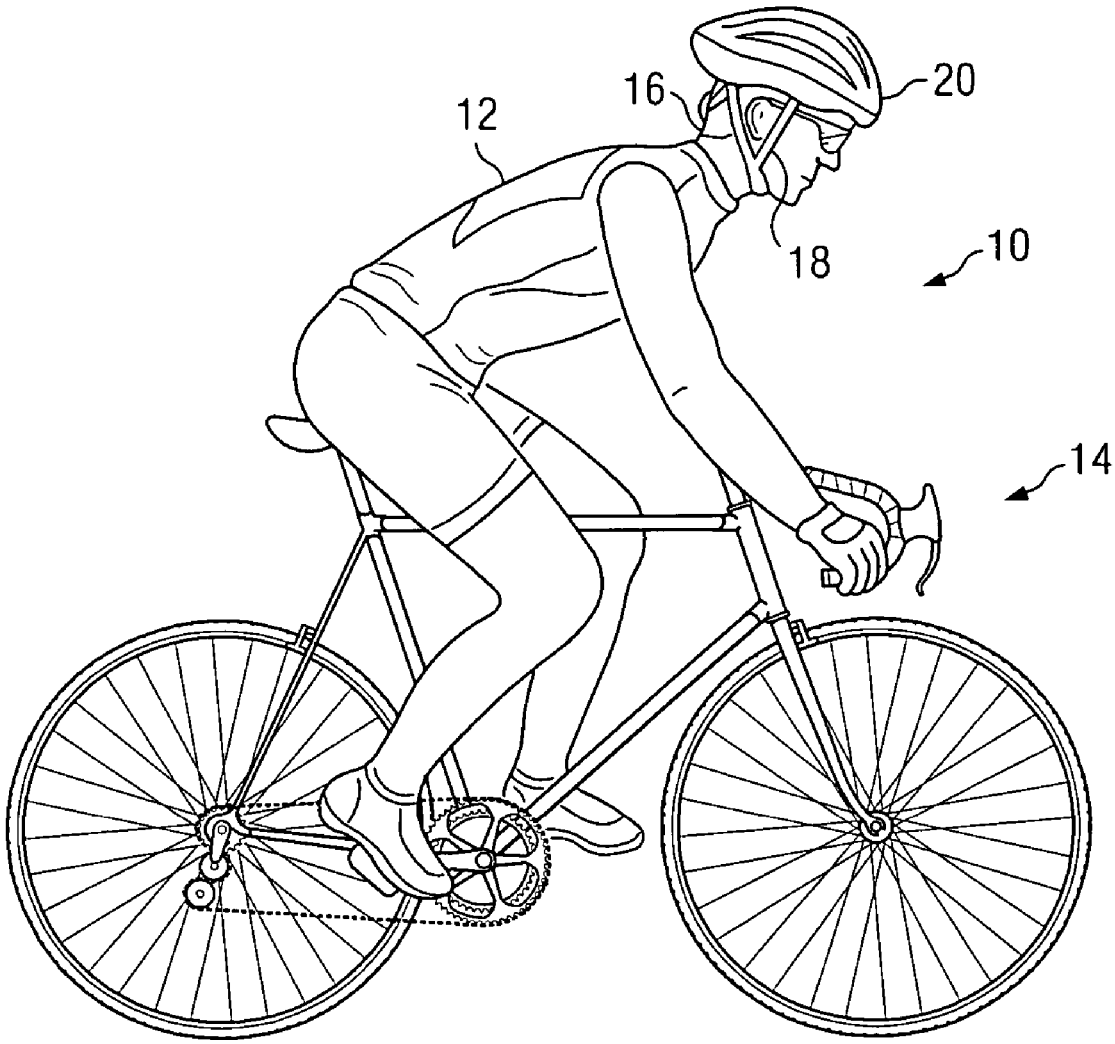
FIG. 1 illustrates an example of an activity where a helmet that may benefit from the teachings of the present invention may be used.

FIG. 1 is a schematic diagram illustrating one example of an environment 10 in which head gear 20 according to one or more embodiments of the present invention may be used. As shown in FIG. 1, environment 10 includes a bicyclist (user) 12 riding a bicycle 14 wearing head gear 20 on a head 16 of user 12. Head gear 20 is secured to head 16 of user 12 through the use of straps 18. One example of head gear 20 is a helmet, and for illustrative purposes, a helmet 20 is used as an example of head gear 20. The term "helmet" as used herein, includes any type of protective head gear, such as a bicycle helmet, a motorcycle helmet, and a hard hat. Although helmet 20 is used as an example to describe some embodiments of the invention, any type of head gear, both protective and non-protective, may benefit from the teachings of the present invention. An example of a non-protective head gear is a hat.

Referring again to FIG. 1, if user 12 were to fall off of bicycle 14 due to an accident, user 12 may suffer various injuries, including an impact to head 16. Because the use of a protective head gear such as helmet 20 may reduce the severity of trauma to head 16 in case of an impact, the use of helmet 20 is strongly encouraged for many activities where the probability of injury to head 16 is relatively high. The proper fitting and positioning of helmet 20 maximizes the level of protection offered to user 12. This, in conjunction with the levels of comfort and convenience associated with helmet 20, affect the overall quality of helmet 20.

A conventional helmet may include a fitting system that is uncomfortable and inconvenient for a user. For example, a mechanism for adjusting a belt that fits around the circumference of a user's head may be cumbersome to use and may not allow the user to achieve a consistently snug fit. In addition, the belt, which is often made using soft, flexible material, may become prematurely worn after repeated adjustment of the belt. Straps of a helmet that are used to secure the helmet may also become tangled when the helmet is removed from the user's head which requires the user to untangle the straps before wearing the helmet again. Furthermore, padding that may be used to line the belt to provide comfort for the user may fit poorly around the belt, which may result in rolls and kinks that can cause discomfort and inconvenience. Such a padding material us removably coupled to the belt so that the pad may be washed. Fastening the liner to the belt may also be difficult. For example, where Velcro is used to attach the liner to the belt, the belt is glued to the hook-portion of Velcro to engage the liner. However, the material that is generally used to form the surface area of the belt does not adhere well to such adhesives. Thus, the Velcro may become separated from the belt, especially when there is a variance of ambient temperature (a drop in temperature, for example). Instead of using an adhesive material, a liner may also be buttoned to the belt of a helmet. However, the button may dig into the head the helmet is worn, and thus becomes a source of discomfort and a potential safety hazard.

According to certain embodiments of the present invention, a helmet that offers an improved level of convenience, comfort, and safety is provided. In one embodiment, a belt is more conveniently fitted around the head of a user by providing a belt adjustment device that allows a user to tighten the belt using his/her thumb and also allows the user to loosen the belt with one touch of a release mechanism that is separately located from the adjustment mechanism. In particular embodiments, the management of straps of a helmet is improved by threading a portion of the straps through the belt adjustment device to separate the straps. In certain embodiments, the life of the belt is extended by providing flange-supported gear teeth at a portion of the belt that is used to tighten or loosen the belt around the user's head. Furthermore, in particular embodiments, the level of comfort for a user is improved by providing a pad that includes compressed strips to bow out the pad against the belt and to prevent the puffing of the compressed strips when the pad is woven through the belt. In addition, in certain embodiments, the pad may be securely fastened to the belt without sacrificing safety and comfort by providing one or more collapsible buttons in the belt to secure the pad.

Moreover, in particular embodiments, the fit of the helmet on a user's head is improved by forming a rear portion of the belt that hugs the lower portion of the occiput of the user's head. Additional details of such example embodiments of the invention are described below in greater detail in conjunction with FIGS. 2-9C.

Figure 2:
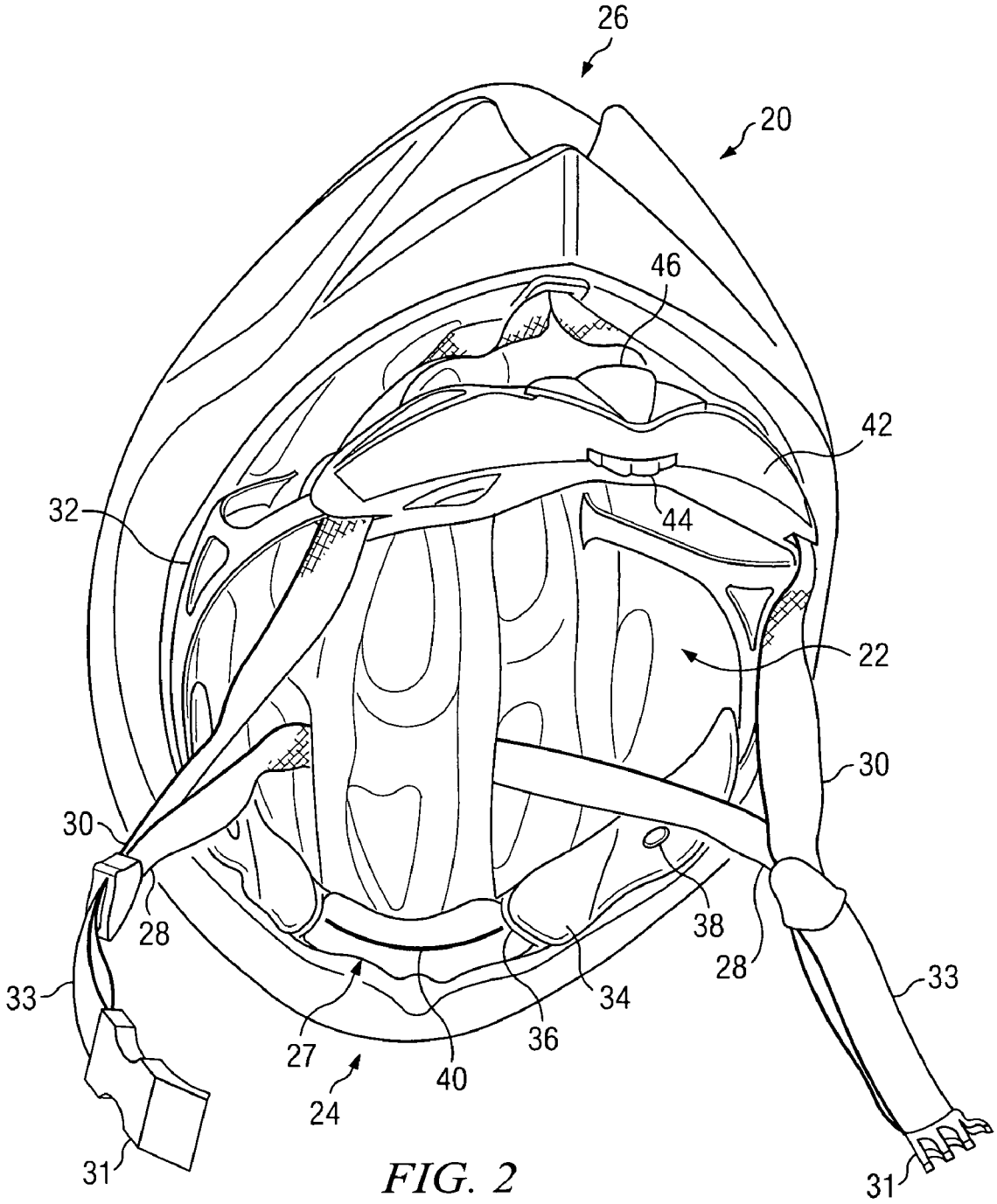
FIG. 2 is a diagram illustrating a perspective view of the inside of the helmet shown in FIG. 1.

FIG. 2 is a diagram illustrating a perspective view of the interior 22 of helmet 20 shown in FIG. 1. Helmet 20 includes a front portion 24, a rear portion 26, and an inner rim 27 disposed in interior 22 of helmet 20. Helmet 20 also includes front straps 28 that are coupled to a portion of helmet 20 close to front portion 24 and rear straps 30 that are anchored in proximity of rear portion 26 of helmet 20. The ends of straps 28 and 30 converge on each side of helmet to form chin straps 33. Each chin strap 33 is coupled to either a male or female portion of a buckle 31. When the male and female portions of buckle 31 are mated while user is wearing helmet 20, chin straps 33 form a loop under the chin of user 12.

Figure 5A:
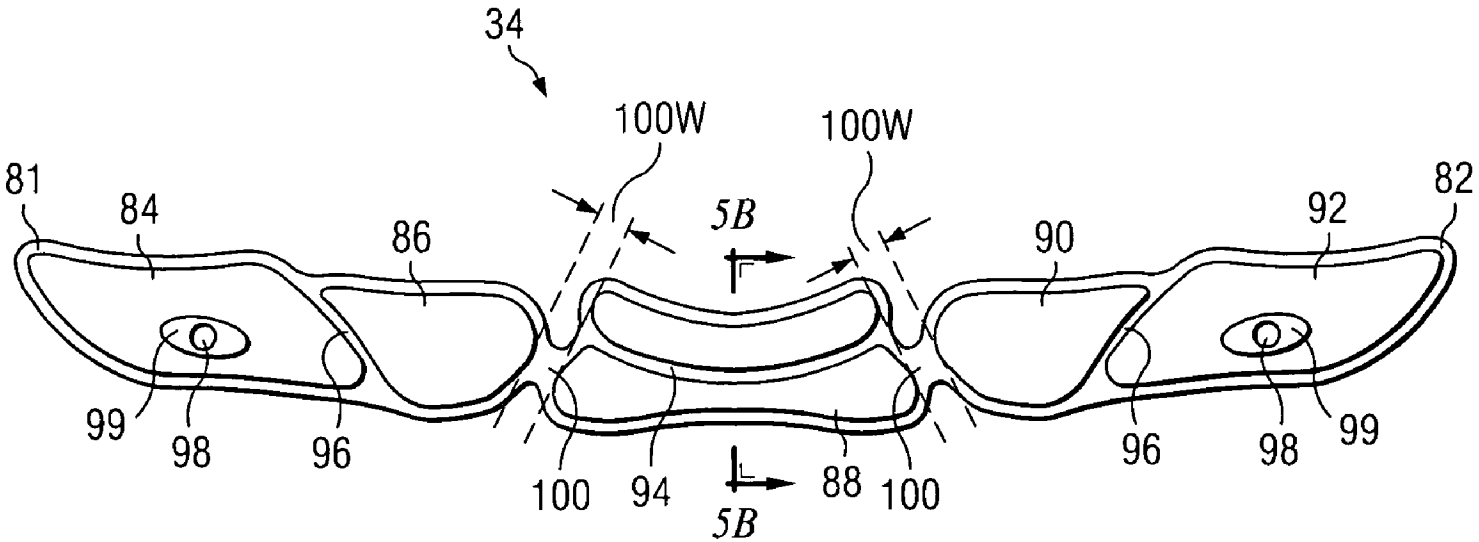
FIG. 5A is a diagram illustrating one embodiment of a pad that may be used in conjunction with the belt shown in FIG. 3.

A belt 32 is disposed in the interior 22 of helmet 20 at least partly along inner rim 27, as shown in FIG. 2. End portions (not explicitly shown in FIG. 2) of belt 32 extend toward rear portion 26 of helmet 20 and are coupled at the rear position 26 using a belt adjustment device 42. A pad 34 may be woven through a plurality of ribs 36 of belt 32. To further secure pad 34 to belt 32, belt 32 may include a plurality of collapsible buttons 38. In one embodiment, pad 34 may include a compressed strip 40 that is positioned along the length of pad 34, as shown in FIG. 5A.

Belt adjustment device 42 is provided in conjunction with belt 32 to receive the end portions of belt 32 and to provide a mechanism for tightening belt 32 around the user's head. The end portions of belt 32 are not explicitly shown in FIG. 2 because the end portions are inserted into belt adjustment device 42. However, additional details concerning the end portions of belt 42 are provided below in conjunction with FIGS. 3, 7A, and 7B. Referring back to FIG. 2, belt adjustment device 42 is operable to allow user 12 to urge the end portions of belt 32 in opposing directions to either tighten or loosen belt 32. Belt adjustment device 42 includes an adjuster 44 and a release actuator 46 that is separately positioned from adjuster 44. User 12 may move adjuster 44 in one direction to tighten belt 32 around head 16 shown in FIG. 1. In response, the end portions of belt 32 may be ratcheted towards each other to tighten belt 32. To loosen belt 32, user 12 may press release actuator 46, which allows the end portions of belt 32 to travel away from each other and thus loosen belt 32. Additional details of example embodiments of belt 32, collapsible button 38, pad 34, and belt adjustment device 42 are described below in greater detail in conjunction with FIGS. 3-9C.

Figure 3:
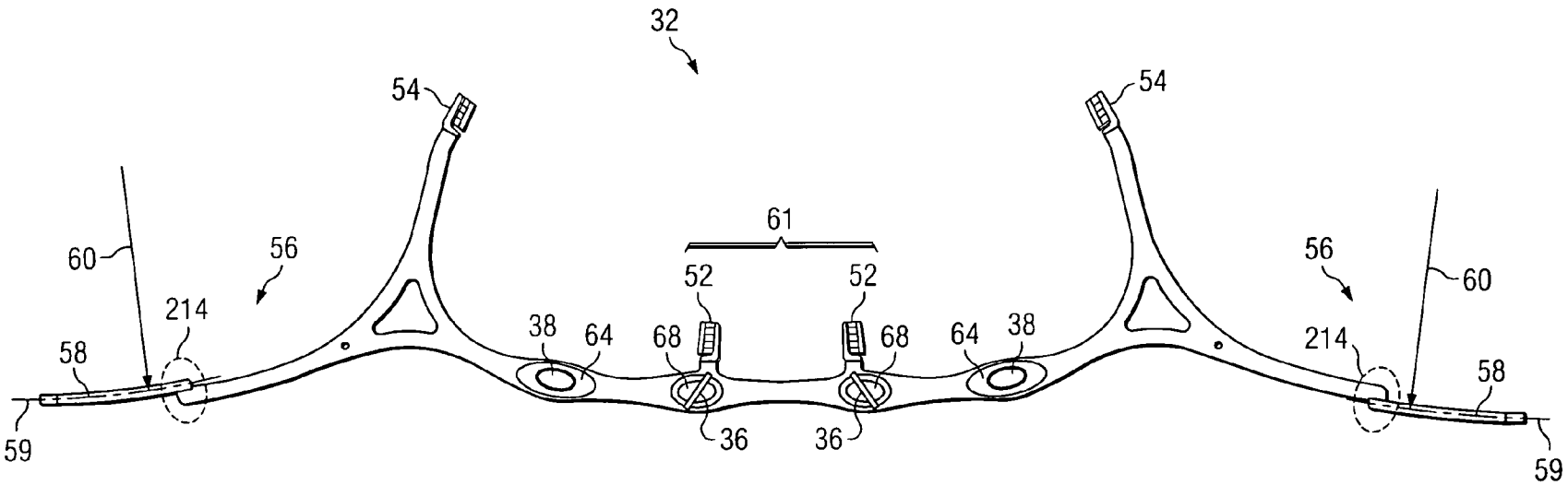
FIG. 3 is a diagram illustrating one embodiment of a belt of the helmet shown in FIG. 2.

FIG. 3 is a diagram illustrating one embodiment of belt 32 shown in FIG. 2. In one embodiment, belt 32, including all components of belt 32 shown in FIG. 3, may be formed from any suitable flexible material, such as low density polyethylene (LDPE). In one embodiment, belt 32 includes front attachment tabs 52 and side attachment tabs 54 that may be used to secure belt 32 to interior 22 of helmet 20 shown in FIG. 2. For example, tabs 52 and 54 may be inserted into slots (not explicitly shown) defined by the inner surface of helmet 20 and an adhesive or other suitable technique may be used to fix tabs 52 and 54 in helmet 20. In certain embodiments, a self-locking fastener may also be used, as described in U.S. Pat. No. 6,447,776 B1, issued on Sep. 17, 2002. Belt 32 also includes end portions 56 each having a rack 58 that is offset by a junction 214. Additional details describing some embodiments of rack 58 and junction 214 are provided below in conjunction with FIGS. 7A and 7B. Referring back to FIG. 3, both racks 58 of end portions 56 are operable to be received by belt adjustment device 42 shown in FIG. 2.

Belt 32 also defines a plurality of holes 64 and 68. A rib 36 is positioned across each hole 68. A button 38 is suspended over each hole 64. Holes 68 and corresponding ribs 36 may be used to weave a pad 34 to belt 32, as shown in FIG. 2. Buttons 38 also may be used to secure pad 34 to belt 32. In one embodiment, button 38 is suspended over hole 64 by a pair of collapsible legs (shown in FIGS. 4A through 4D). The footprint of button 38 fits within hole 64. This is advantageous in some embodiments because when user 12 wearing helmet 20 is involved in a crash, any point load that may be transferred to head 16 of user 12 via buttons 38 is minimized because buttons 38 are configured to partially or entirely collapse into corresponding holes 64. Additional details describing one embodiment of button 38 are provided below in conjunction with FIGS. 4A-4D.

In particular embodiments, as shown in FIG. 3, each end portion 56, including rack 58, defines a curvature (as shown by a phantom curved line 59) having a radius of curvature 60 between 14 and 18 inches. In one embodiment, radius 60 is 16 inches. This is advantageous in some embodiments because when end portions 56 meet or overlap to form one continuous curvature having radius 60, the resulting curvature engages the lower half of the back of a user's head 16 (referred to herein as an "occiput"), which pulls helmet 20 against head 16 and thus better secures helmet 20 on head 16. Further, the curvature of racks 58 causes belt adjustment mechanism 42 to rise and cup the occiput of user 12, which allows helmet 20 to accommodate a wide range of head shapes and sizes.

Figure 4A:
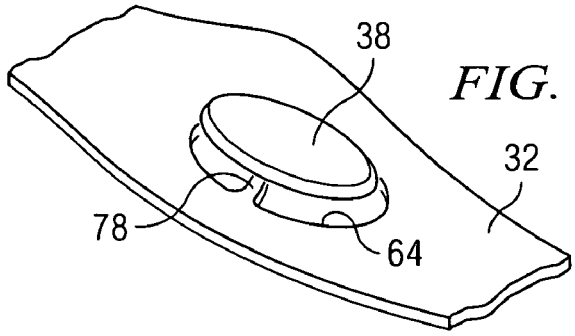
FIG. 4A is a diagram illustrating a perspective view of one embodiment of a button shown in FIG. 3.
Figure 4B:
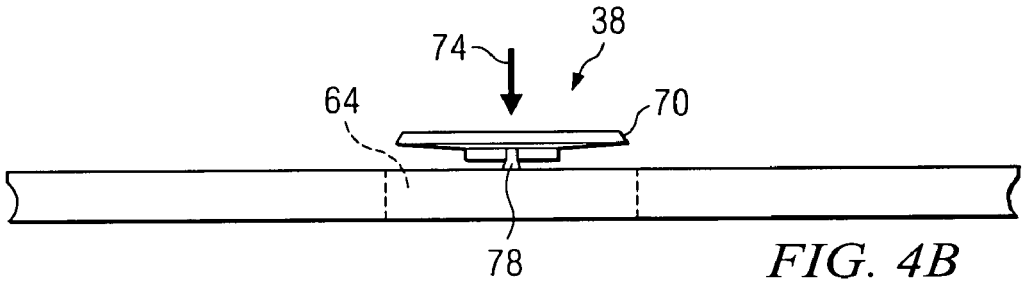
FIG. 4B is a diagram illustrating a side view of the button shown in FIG. 4A.
Figure 4C:
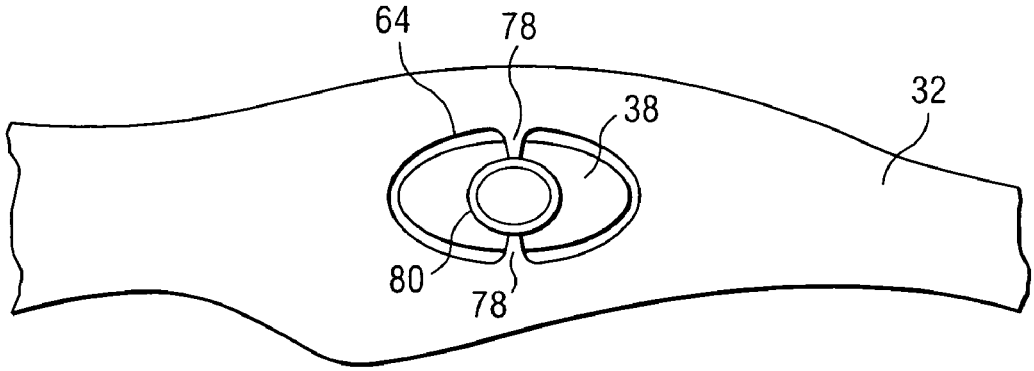
FIG. 4C is a diagram illustrating a bottom view of the button shown in FIG. 4A.
Figure 4D:
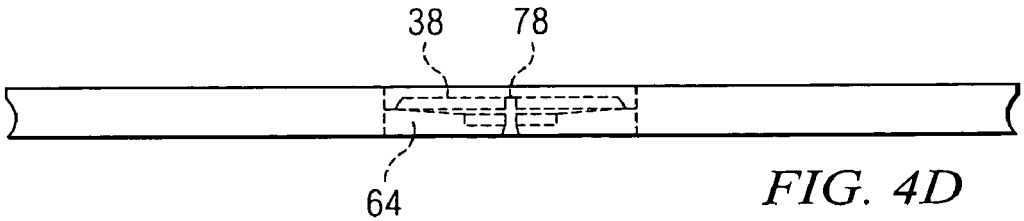
FIG. 4D is a diagram illustrating a side view of the button shown in FIG. 4A when the button is collapsed.

FIG. 4A is a diagram illustrating a perspective view of one embodiment of button 38 shown in FIG. 3. FIG. 4B is a diagram illustrating a side view of button 38 shown in FIG. 4A. FIG. 4C is a diagram showing a bottom view of button 38 shown in FIG. 4A. FIG. 4D is a diagram illustrating a side view of button 38 when button 38 is collapsed. FIGS. 4A-4D are described jointly. Referring to and as shown in FIG. 4A, button 38 is suspended over hole 64 by collapsible legs 78. Although two legs 78 are shown in FIG. 4A, any suitable number of legs 78 may be used. Legs 78 may be formed from a flexible material, such as low density polyethylene/linear polyethylene. In certain embodiments, buttons 38 are molded as an integral part of belt 32. Button 38 has a footprint that fits within hole 64, which allows button 38 to collapse into hole 64 to avoid transferring external impact energy or other types of point pressure to the head 16 of user 12.

Referring to FIG. 4B, button 38 has an outer edge 70 and a center 74. In particular embodiments, the thickness of button 38 increases from edge 70 to center 74. This is advantageous in some embodiments of the invention because having a thicker center 74 provides structural support for button 38 which prevents button 38 from folding along center 74. Because of this structural support, the surface area of button 38 may be increased, which allows button 38 to better secure pad 34.

As illustrated in FIG. 4C, in certain embodiments, the bottom of button 38 may include a support ring 80. Support ring 80 provides additional structural support for button 38. In certain embodiments, support ring 80 has a diameter that approximately matches a button hole of pad 34 (The button hole is described below in conjunction with FIG. 5A). When pad 34 is placed over button 38, support ring 80 at least partly fits within the button hole, which prevents pad 34 from shifting. Support ring 80 may be positioned close to a junction between button 38 and collapsible legs 78. This is advantageous in some embodiments because support ring 80 resists wear of the button hole of pad 34. Support ring 80 may also resist wear at the junction between leg 78 and button 38 due to friction and/or repeated collapse of button 38. Referring again to FIG. 4B, in certain embodiments, the thickness at center 74 of button 38 is greater than at edge 70 of button 38 because a support structure, such as support ring 80, is added to center 74.

Referring to and as shown in FIG. 4D, button 38 may be depressed into hole 64. When force is applied to button 38, legs 78 are able to deform to allow button 38 to collapse into hole 64. When the force is removed, legs 78 spring back to their original position and lift button 38 back above hole 64.

FIG. 5A is a schematic diagram illustrating one embodiment of pad 34 shown in FIG. 2. Pad 34 includes an end 81, an end 82, and a length that extends from end 81 to end 82. Pad 34 also includes a plurality of sections 84, 86, 88, 90, and 92 that are positioned along the length of pad 34. Although five sections 84, 86, 88, 90, and 92 are shown in FIG. 5A as an example, pad 34 may include any suitable number of sections. As shown in FIG. 5A, section 84 is separated from section 86 by a compressed strip 96, section 86 and 88 are separated from each other by a compressed strip 100 having a width 100 W, sections 88 and 90 are separated from each other by a compressed strip 100, and sections 90 and 92 are separated from each other by a compressed strip 96.

In one embodiment, compressed strips 94, 96 and 100 may be formed by compression molding; however, any suitable process may be used to form compressed strips 94, 96 and 100. The outer boundary of pad 34 may also be compression molded to better maintain the integrity of pad 34. Compressed strips 96 are used to allow pad 34 to fold along compressed strips 96 so that pad 34 can conform to the contour of belt 32 when belt 32 is attached to helmet 20. The orientation of each compressed strip 100 and width 100 W of compressed strip 100 may be adjusted to match the width and the orientation of a corresponding rib 36 of belt 32, as shown in FIG. 3. For example, where pad 34 is woven through holes 68 and ribs 36 of belt 32 shown in FIG. 3, each compressed strip 100 has an orientation and width 100 W that matches the orientation and the width of its corresponding rib 36. An example of this matching of the rib 36 and compressed strip 100 is shown in FIG. 2. This is advantageous in some embodiments because such compressed strips 100 reduce the amount of puffing when pad 34 is woven through belt 32. Additionally, the difference in thickness between compressed strip 100 and the surrounding sections reduces the shifting of pad 34 along the length of belt 32.

In one embodiment, a lateral compressed strip 94 may be formed in a particular section that is prone to bunching or bowing when pad 34 is coupled to belt 32. For example, as shown in FIG. 5A, lateral compressed strip 94 is formed in section 88 approximately along the length of pad 34. Lateral compressed strip 94 is positioned in section 88 because section 88 corresponds to a portion of belt 32 that is at front 34 of helmet 20. Because the front portion 34 of helmet has a relatively extreme curvature (compared to the side portion of the helmet, for example), the probability of bunching or bowing-in at section 88 when pad 34 is coupled to belt 32 is higher than in other sections 84, 86, 90, and 92. Thus, lateral compressed strip 94 encourages section 88 to bow outward, which prevents the bunching and the bowing-in of section 88. In one embodiment, lateral compressed strip 94 has an arcuated profile, which further encourages section 88 to bow outwardly rather than inwardly.

In certain embodiments where buttons 38 are used to secure pad 34 to a belt, such as belt 32 shown in FIG. 3, suitably sized button holes 98 may be defined by pad 34. Referring to both FIGS. 5A and 4A, hole 98 of pad 34 is fitted over button 38 so that an area 99 of pad 34 immediately surrounding button hole 98 is positioned between button 38 and hole 64 shown in FIG. 4A. Thus, pad 34 is coupled to belt 32 by button 38. In certain embodiments, area 99 defining button hole 98 may be compressed to approximately match the size and shape of button 38 shown in FIG. 4A to urge button 38 away from head 16 when user 12 is wearing helmet 20. Button 38 is urged away from head 16 because compressed area 99 allows button 38 to fit within compressed area 99 when button 38 is fitted through button hole 98. Because button 38 is within compressed area 99, uncompressed portions of pad 34 that has a greater thickness than compressed area 99 of pad 34 push button 38 away from head 16, which increases the level of comfort offered to user 12. Depending on the difference of thickness between compressed area 99 and uncompressed portions of pad 34, a gap may be formed between button 39 and head 16 of user 12 when user 12 is wearing helmet 20, which further increases the level of comfort offered to user 12.

Figure 5B:
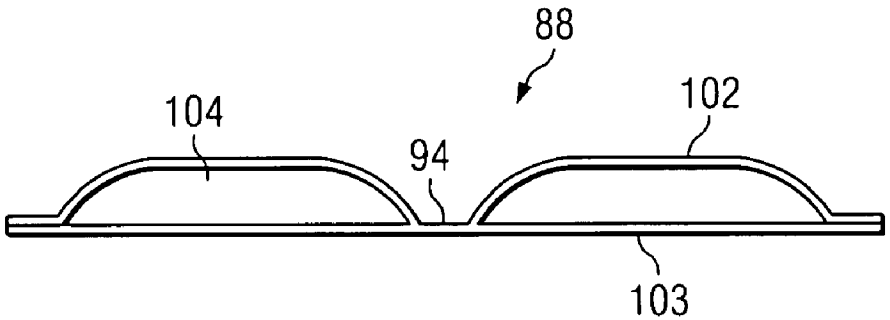
FIG. 5B is a cross-sectional view of the pad shown in FIG. 5A.

FIG. 5B is a cross-sectional view of pad 34 shown in FIG. 5A. Pad 34 is formed from a base 103, a shell 102, and a filler 104. In one embodiment, shell 102 is formed using DEHANG "PLUM BLOSSOM MESH" having a fabric weight of approximately 210 gram per yard, base 103 is formed using brushed nylon that is Velcro-compatible, and filler 104 is formed from foam polyester having a density in a range of 1.6 to 1.8 pounds per cubic foot. However, any material may be used to form base 103 and shell 102. Further, any suitable material that provides comfort for user 12 may be used as filler 104.

Figure 6A:
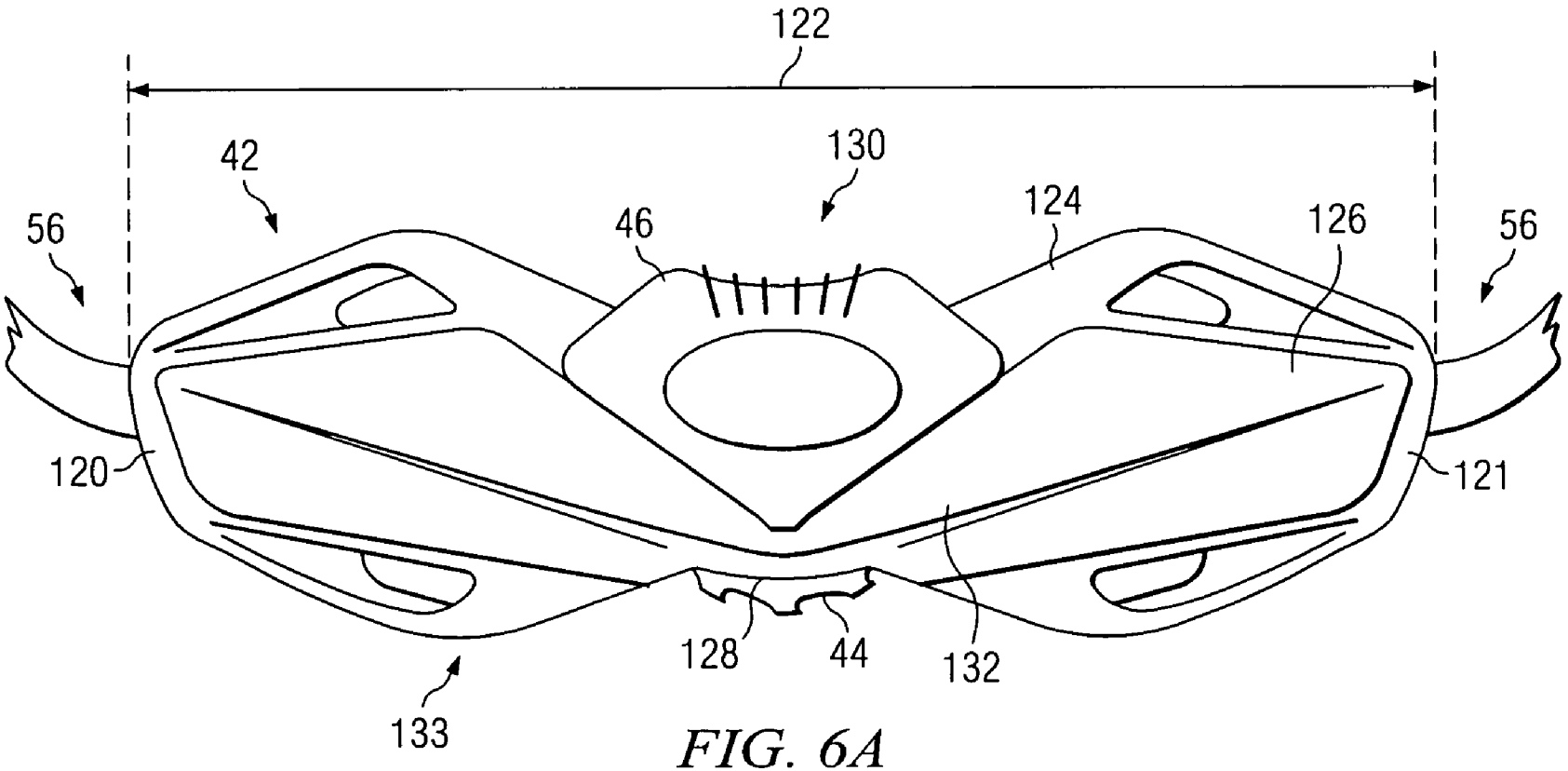
FIG. 6A is a diagram illustrating one embodiment of a belt adjustment device shown in FIG. 2.

FIG. 6A is a diagram illustrating one embodiment of belt adjustment device 42 shown in FIG. 2. Device 42 comprises a base 124 that includes a cover 126, an end 120, and an end 121. Base 124 defines an aperture 128, an aperture 130 (not explicitly shown in FIG. 6A), and a channel (shown explicitly as a channel 125 in FIG. 6B) that extends between ends 120 and 121. Adjustment device 42 also includes an adjuster 44 that at least partly protrudes out of aperture 128 and a release actuator 46 that is coupled to adjuster 44 through aperture 130. Device 42 has a length that is defined along base 124 between ends 120 and 121. Adjustment device 42 is operable to receive end portions 56 of belt 32 in channel 125 through ends 120 and 121. Adjustment device 42 also comprises a convex face 132 and a concaved face 133 that is opposite from convex face 132. Concaved face 133 is not explicitly shown in FIG. 6A.

In the illustrated embodiment, adjuster 44 and release actuator 46 are positioned opposite each other. For example, as shown in FIG. 6A, adjuster 44 is at the bottom of device 42 and release actuator 46 is at the top of device 42. This is advantageous in some embodiments because a user may reach behind head 16 to operate adjuster 44 by using the user's thumb to tighten belt 32 and/or to operate release actuator 46 using user's other fingers to loosen belt 32. Ends 120 and 121 are separated by a distance 122 of approximately 134.6 mm, in one embodiment. However, depending on the design specifications of adjustment device 42, ends 120 and 121 may be separated by any suitable distance.

Figure 6B:
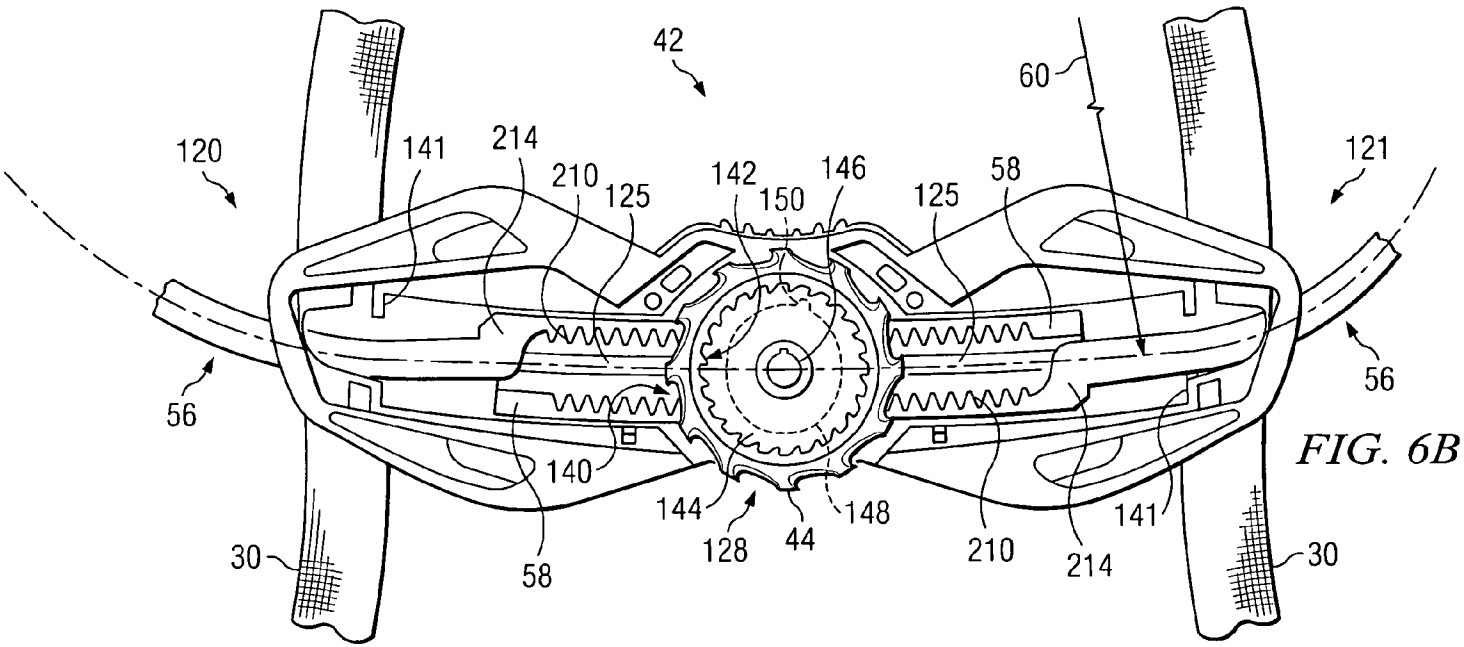
FIG. 6B is a diagram illustrating one embodiment of an adjuster of the belt adjustment device shown in FIG. 6A.

FIG. 6B is a diagram illustrating one embodiment of adjuster 44 shown in FIG. 6A. As shown in FIG. 6B, adjuster 44 is a wheel comprising a grip portion 140, a cavity 144 defining a plurality of internal gear teeth 142, and a center axis 146. Adjuster 44 is attached to a pinion gear at a side that is opposite from the side defining internal gear teeth 142, and positioned in channel 125. The pinion gear is not explicitly shown in FIG. 6B, but is described in conjunction with FIGS. 6E, 6G, and 8A. As shown in FIG. 6B, channel 125 is operable to receive racks 58 and position racks 58 so that both racks 58 engage the pinion gear. Stops 141 are positioned in channel 125 to prevent end portions 56 from being pulled out of belt adjustment device 42, as described below in conjunction with FIG. 7A.

Referring to and as shown using a phantom line in FIG. 6B, a hoop spring 148 including a pawl 150 is positioned within cavity 144 of adjuster 44. Pawl 150 is sloped so that when hoop spring 148 is in an engaged position, internal gear teeth 142 may travel in one direction but not in an opposite direction. The turning of adjuster 44 in the direction allowed by pawl 150 also turns the attached pinion gear. The pinion gear draws both racks 58 toward each other along channel 125. In turn, belt 32 is tightened around head 16 of user 12 in a ratcheting manner. The use of hoop spring 148 is advantageous in some embodiments because the shape of hoop spring 148 allows a more compact design of adjuster 44 when adjuster 44 is circular. However, any suitable spring, such as a compression spring, leaf spring, or a bow spring, may be used to urge pawl 150 against internal gear teeth 142 of adjuster 44. As described below in conjunction with FIG. 6C, in one embodiment, hoop spring 148 and pawl 150 are positioned in conjunction with cover 126.

Figure 6C:
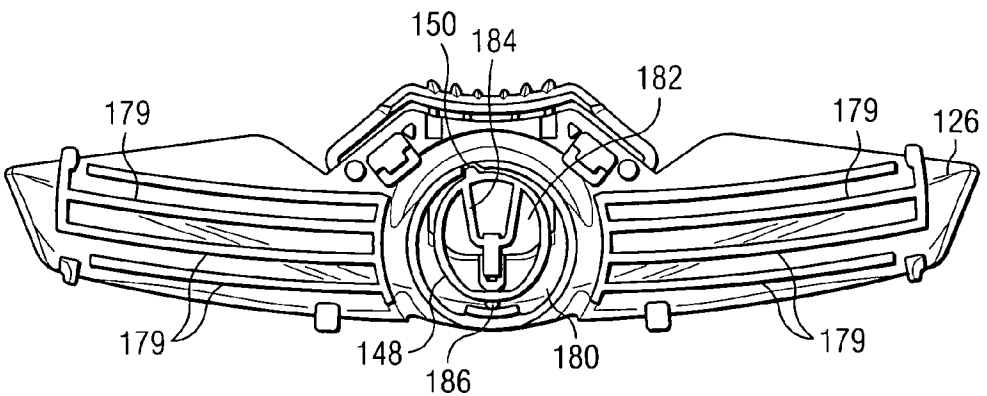
FIG. 6C is a diagram illustrating example embodiments of a release actuator and a hoop spring of the belt adjustment device shown in FIG. 6A.

FIG. 6C is a schematic diagram illustrating example embodiments of release actuator 46 and hoop spring 148 coupled to the interior of one embodiment of cover 126. Cover 126 defines an aperture 182, a cavity 180, a platform 186, and a plurality of ribs 179. Hoop spring 148 and pawl 150 attached to hoop spring 148 are positioned inside cavity 180 and over platform 186, as shown in FIG. 6C. Release actuator 46 is coupled to loop 184 attached to hoop spring 148 through aperture 182. When cover 126 is positioned over base 124 and end portions 56, ribs 179 operate as stabilizers that hold down end portions 56 in channel 125.

Referring to both FIGS. 6B and 6C, in operation, when cover 126 is placed on base 124, pawl 150 engages internal gear teeth 142 of adjuster 44. As shown in FIGS. 6B and 6C, pawl 150 and internal gear teeth 142 are sloped in approximately opposite directions. As adjuster 44 is turned in the direction of the slope of pawl 150, pawl 150, in conjunction with hoop spring 148, allows an incremental movement of adjuster 44 in the direction of the slope. However, if adjuster 44 is urged in an opposite direction of the slope of pawl 150, pawl 150, in conjunction with hoop spring 148, prevents the movement. To disengage pawl 150 from internal gear teeth 142 and allow adjuster 44 to travel in the direction opposite from the slope of pawl 150, release actuator 46 may be depressed to urge hoop spring 148 against platform 186, which compresses hoop spring 148 and lowers pawl 150. When pawl 150 is lowered, pawl 150 is disengaged from internal gear teeth 142 of adjuster 44, which allows adjuster 44 to travel in both directions.

Figure 6D:
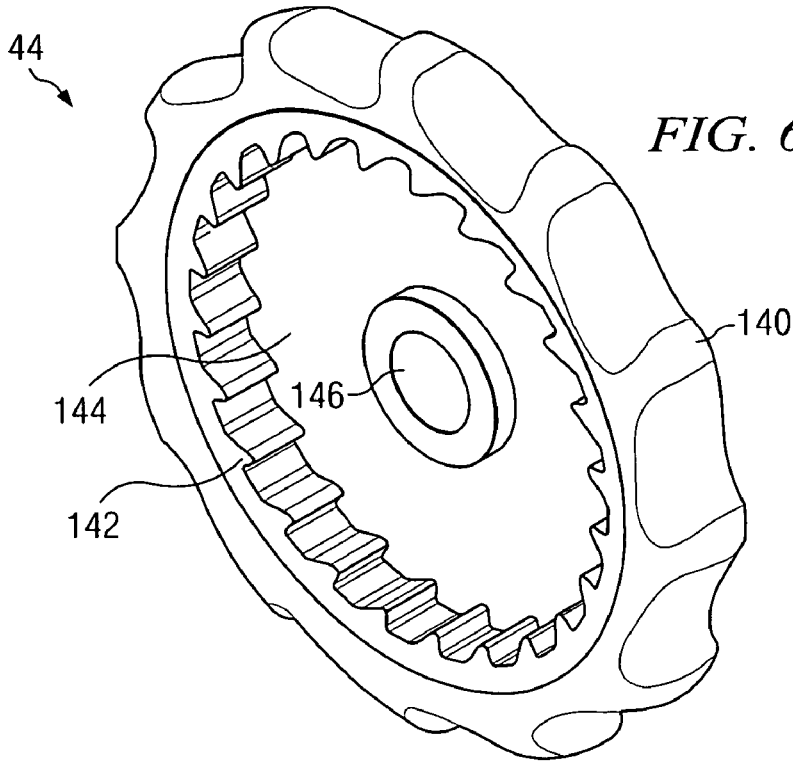
FIG. 6D is a diagram illustrating a perspective view of one embodiment of internal gear teeth of the adjuster shown in FIG. 6B.
Figure 6E:
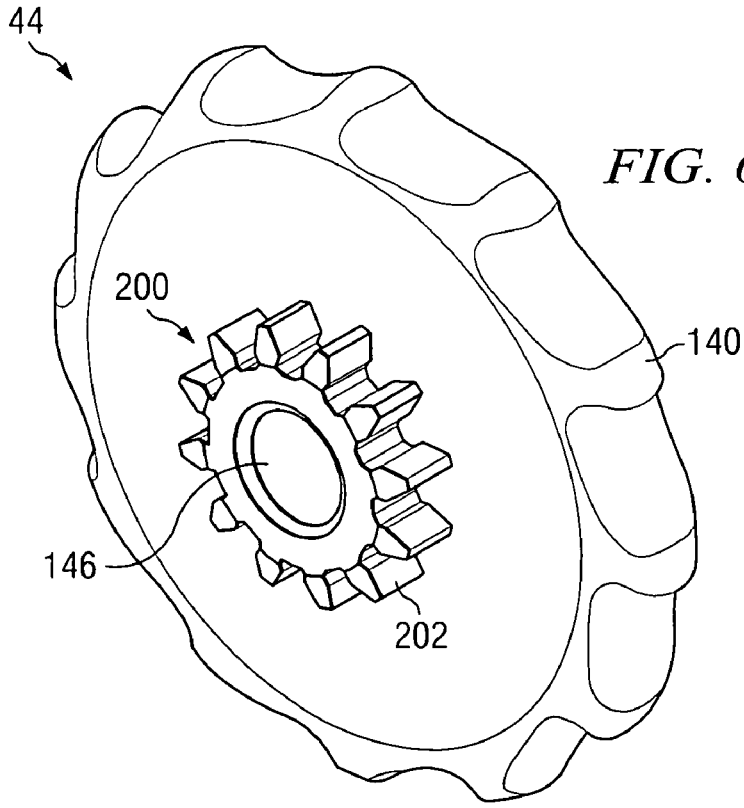
FIG. 6E is a diagram illustrating a perspective view of one embodiment of a pinion gear of the adjuster shown in FIG. 6D.

FIG. 6D is a diagram illustrating a perspective view of internal gear teeth 142 of adjuster 44. FIG. 6E is a diagram illustrating one embodiment of a pinion gear 200 that is attached to adjuster 44 on the side opposite from the side shown in FIG. 6D. FIGS. 6D and 6E are described jointly. Referring to FIG. 6D, adjuster 44 comprises center axis 146, cavity 144 and gear teeth 142 extending approximately toward center axis 146. Referring to FIG. 6E, pinion gear 200 comprises a plurality of gear teeth 202 extend outwardly from center axis 146 of adjuster 44. As adjuster 44 is turned in a particular direction around center axis 146, pinion gear 44 is turned in the same direction around the same center axis 146.

Figure 6F:
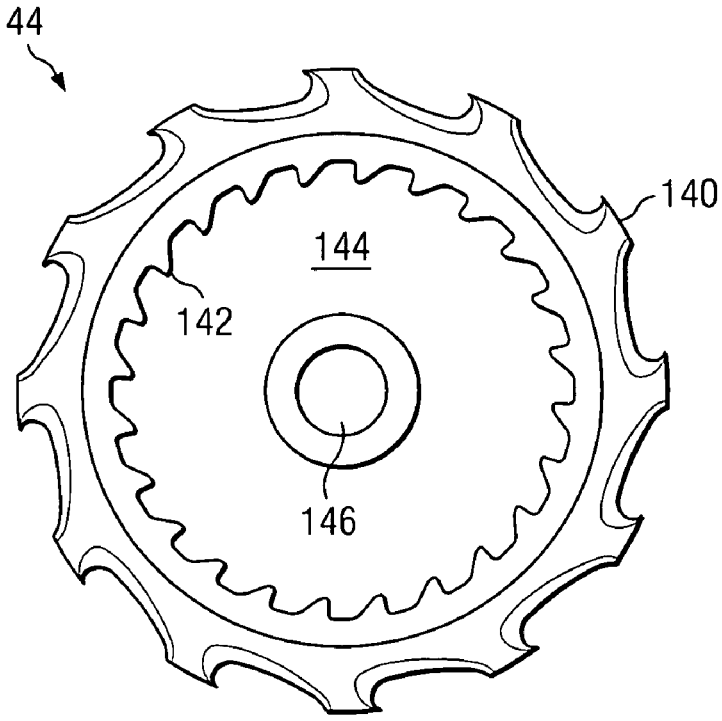
FIG. 6F is a diagram illustrating a frontal view of the internal gear teeth shown in FIG. 6D.
Figure 6G:
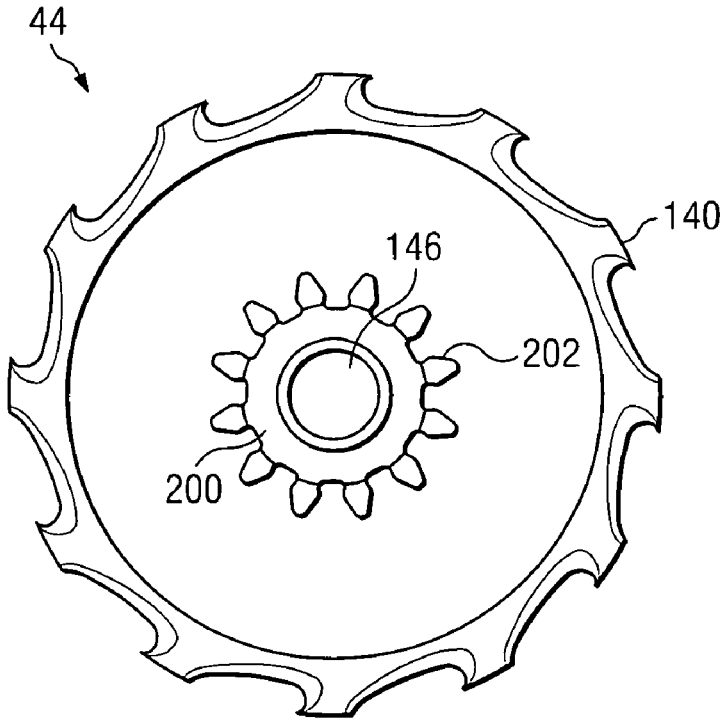
FIG. 6G is a diagram illustrating a frontal view of the pinion gear shown in FIG. 6E.

FIG. 6F is a diagram illustrating a frontal view of internal gear teeth 142 shown in FIG. 6D, and FIG. 6G is a diagram illustrating a frontal view of pinion gear 200 shown in FIG. 6E. As shown in FIG. 6F, internal gear teeth 142 of adjuster 44 are sloped in a particular direction to ride over the slope of pawl 150 shown in FIG. 6B. As shown in FIG. 6G, in one embodiment, the radius of pinion gear 200 is smaller than the radius of adjuster 44. However, the radius of pinion gear 200 may be equal to or larger than the radius of adjuster 44, depending on the particular design of belt adjustment device 42.

Figure 7A:
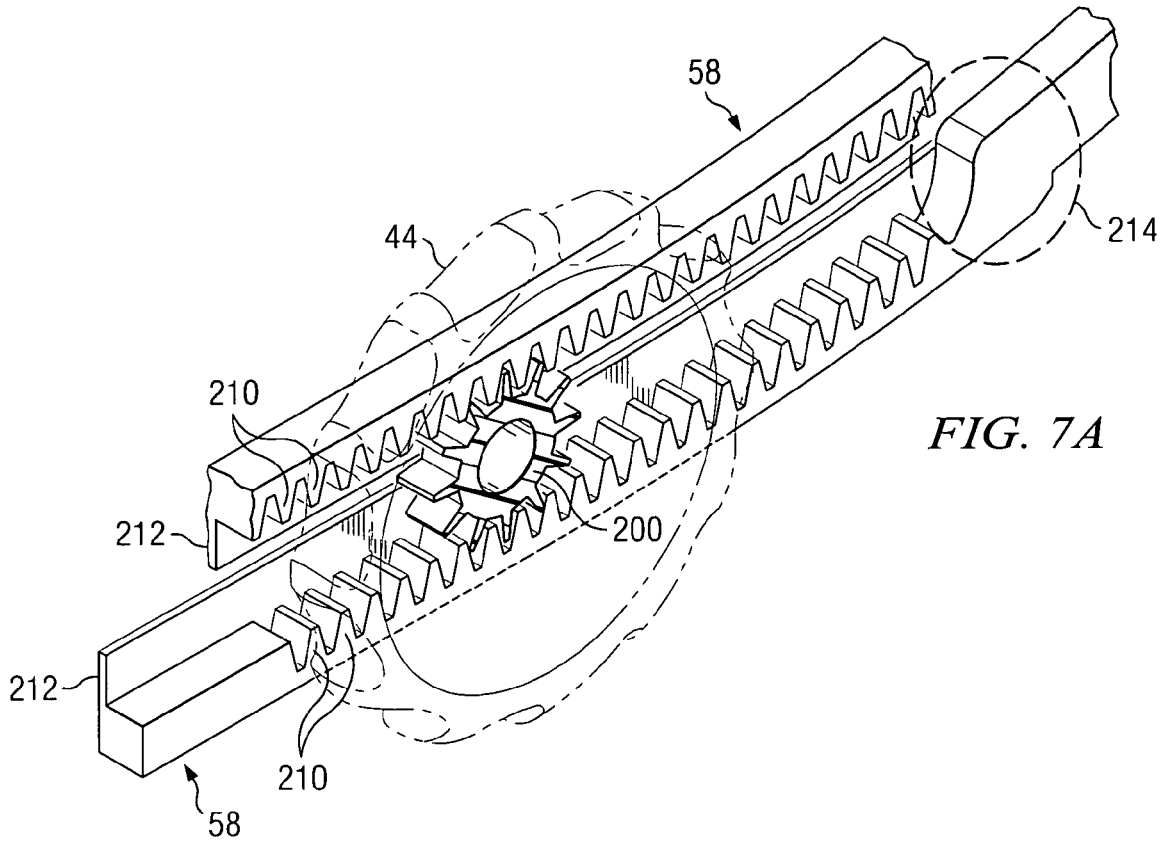
FIG. 7A is a diagram illustrating a perspective view of one embodiment of a rack of the belt shown in FIG. 3.

FIG. 7A is a diagram illustrating one embodiment of rack 58 of end portion 56 of belt 32 shown in FIG. 3. Rack 58 includes a row of gear teeth 210 that is supported on one side by a flange 212. Supporting gear teeth 212 on one side by flange 212 is advantageous in some embodiments because flange 212 allows gear teeth 210, to be formed from soft material, such as low density polyethylene, which would otherwise not be strong enough to use to make teeth 210.

Figure 7B:
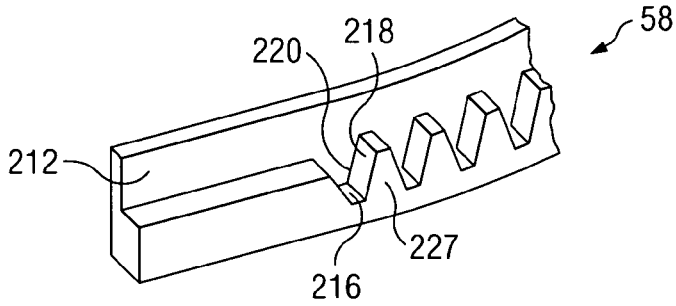
FIG. 7B is a diagram illustrating a perspective view of a gear tooth of the rack shown in FIG. 7A.

FIG. 7B is a diagram illustrating a perspective view of one embodiment of gear tooth 210 shown in FIG. 7A. As shown in FIG. 7B, in one embodiment, each gear tooth 210 comprises a base 216, two opposing sides 220 and 227, and a sloped face that extends from base 216 along sides 220 and 227. Flange 212 is attached to sides 220 of gear teeth 210. This is advantageous in one embodiment because the wear on gear teeth 210 is reduced, which is especially advantageous when gear teeth 210 are formed from soft material, such as linear polyethylene/low density polyethylene. Flange 212 may also prevent elongation between gear teeth 210 under load. In one embodiment, sides 227 are left free of any structure, such as a flange, to allow pinion gear 200 shown in FIG. 6E to engage gear teeth 210.

In one embodiment, gear teeth 210 are appropriately sized to engage gear teeth 202 of pinion gear 200. In one embodiment, as shown in FIG. 7A, rack 58 is slightly offset by junction 214 having an "L" shape. This is advantageous in some embodiments because junction 214 butts against pinion gear 200 when the end of rack 58 is reached, thus operating as a stopping point at which belt 32 can no longer be tightened. Junction 214 may also prevent end portions 56 from being pulled out of belt adjustment mechanism 42 by butting against stops 141 (shown in FIG. 6B) of base 124. Junction 214 may also be used as a reference when assembling belt adjustment device 42 to symmetrically position racks 58. For example, during the assembly of belt adjustment device 42, each junction 214 of end portions 56 may be lined up against the corresponding stop 141 when inserting end portions 56 into channel 125, which allows the respective lengths of racks 58 to be symmetrically positioned within channel 125. In one embodiment, rack 58 is molded as an integral part of belt 32, and may be injection-molded. Rack 58 may be formed from linear polyethylene/low-density polyethylene, in some embodiments. Additional details concerning the interaction of end portions 56 and adjuster 44 shown in FIG. 6B are described below in conjunction with FIG. 8A.

Figure 8A:
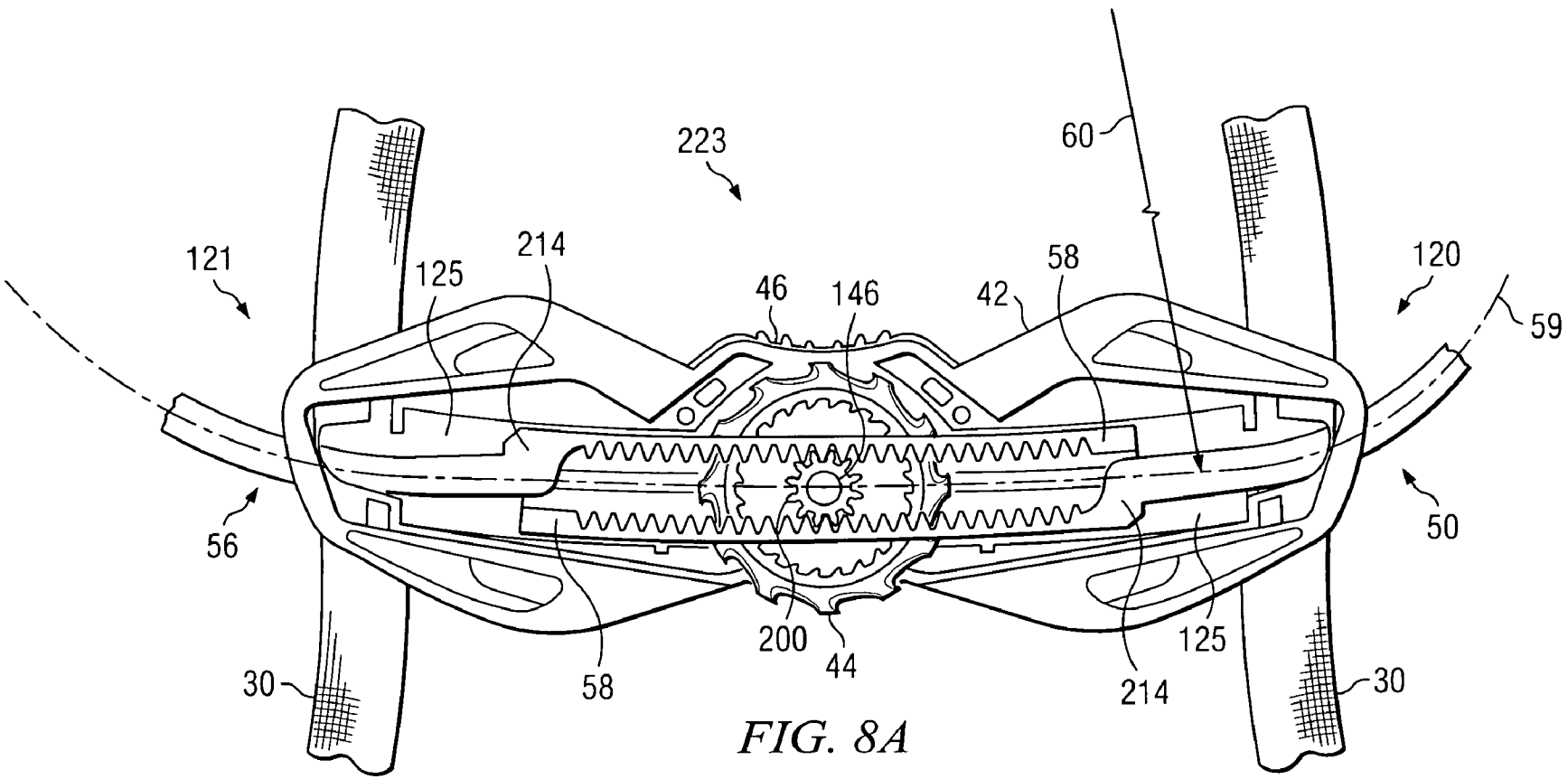
FIG. 8A is a diagram illustrating one embodiment of a rear portion of the belt shown in FIG. 2.

FIG. 8A is a diagram illustrating an interaction between pinion gear 200 shown in FIG. 6D and rack 58 shown in FIG. 7B from a view point of one who is facing the concaved, interior side 134 of belt adjustment device 42, which is opposite the convex, exterior side shown in FIG. 6A. As shown in FIG. 8A, racks 58 of end portions 56 are positioned in channel 125 of belt adjustment device 42 so that gear teeth 210 of upper rack 58 and gear teeth 210 of lower rack 58 extend toward each other, as shown in FIG. 8A. As such, pinion gear 200 may be positioned between racks 58 to engage both racks 58 of end portions 56. As adjuster 44 is turned in a particular direction, adjuster 44 urges end portions 56 to travel in opposite directions along channel 125. When adjuster 44 is turned in the same direction as the slope of pawl 150, end portions 56 are ratcheted in the opposite directions toward each other due to the interaction between internal gear teeth 142 of adjuster 44 and pawl 150 (shown in FIG. 6B), thus tightening belt 32 around head 16. However, when release actuator 46 is actuated, pawl 150 is disengaged from internal gear teeth 142 and adjuster 44 may rotate in both directions, which allows user 12 to loosen belt 32. For example, user 12 may pull belt adjustment mechanism 42 away from head 16 while depressing release actuator 46, which in turn loosens belt 32. Further, as shown in FIG. 8A, offset portions 214 may butt against pinion gear 200, which provides a natural stopping point in the tightening of belt 32.

Referring to both FIGS. 6B and 8A, in one embodiment, channel 125 is curved to match curvature 59 that is formed by joining end portions 56. End portions 56 of belt 32 and belt adjustment device 42 that form the continuous curvature are jointly referred to as a rear portion 223. In certain embodiments, radius 60 of the curvature of rear portion 223 is between approximately 14 and 18 inches, although any suitable radius 60 may be used. In one embodiment, radius 60 is 16 inches. For an appreciable number of users 12 of helmet 20, using the above-described radii allows rear portion 223 to hug the occiput of head 16. This is advantageous in some embodiments because pulling helmet 20 against the occiput provides a more secure fit of helmet 20 on head 16.

Figure 8B:
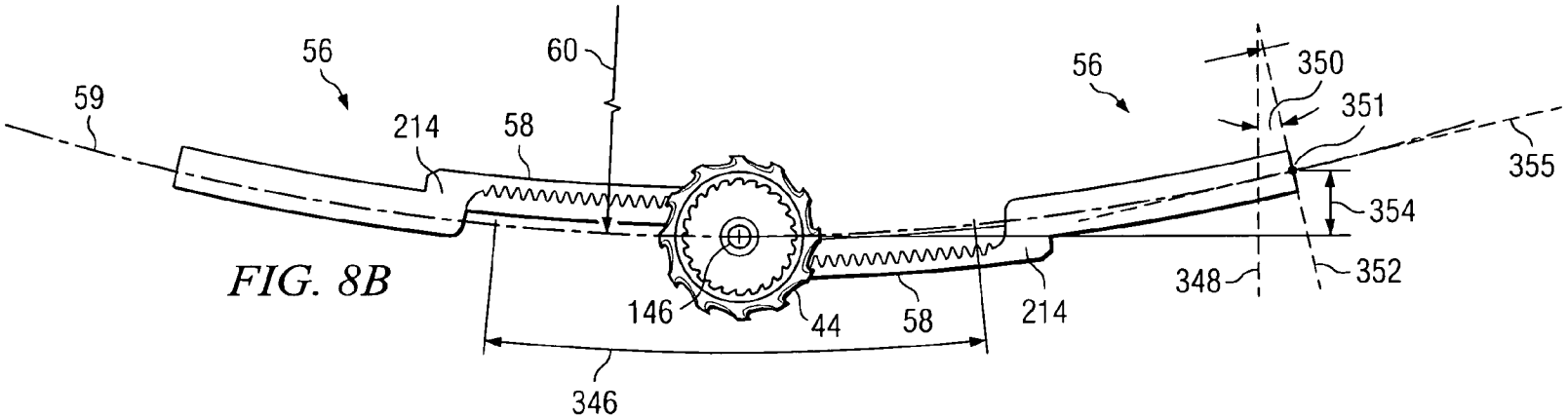
FIGS. 8B-8D are diagrams illustrating an example operation of the belt adjustment device shown in FIG. 8A.
Figure 8C:
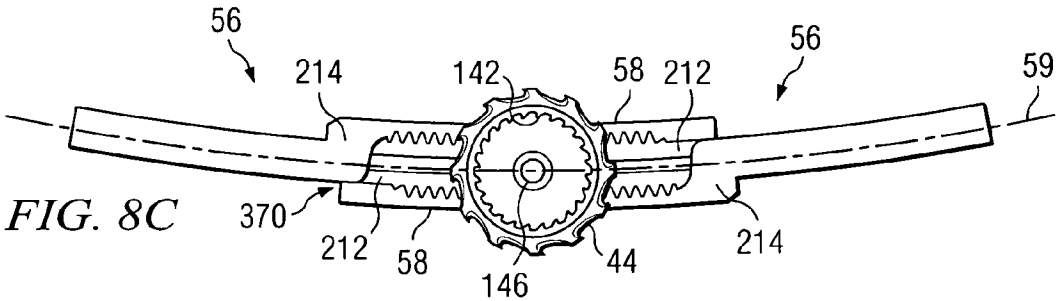
Figure 8D:
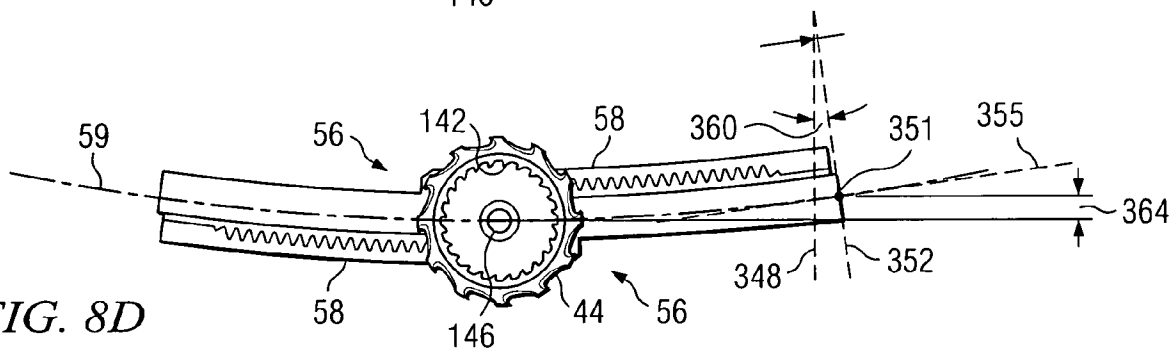

FIGS. 8B-8D are diagrams illustrating end portions 56 being drawn in opposite directions toward each other as adjuster 44 is turned in a direction allowed by pawl 150. FIGS. 8B-8D are described jointly. As shown in FIG. 8B, racks 58 are in a configuration where belt 32 is loosened. Racks 58 have a travel distance 346 before belt 32 is fully tightened. In certain embodiments, travel distance 346 is approximately between 2.5 and 3.5 inches. In one embodiment, travel distance 346 is approximately 3.15 inches. However, any suitable length may be used as travel distance 346. In the configuration shown by FIG. 8B, end portion 56 is at an angle 350. Angle 350 is defined by an imaginary vertical line 348 and an imaginary line 352 that is perpendicular to a line 355 tangent to a point 351 on curvature 59 defined by end portion 56. Center axis 146 of adjuster 44 is at a distance 354 below point 351. Referring to FIG. 8C, in certain embodiments, as end portions 56 are urged in opposite directions toward each other, flange 212 of rack 58 overlap with junction 214 of end portion 56, as shown by reference number 370. This is advantageous because such an overlap serves as an added guide to keep racks 58 in their paths along curvature 59.

Referring to and as shown in FIG. 8D, end portions 56 are drawn toward each other to a point where travel distance 346 (shown in FIG. 8B) is completely closed. In such a configuration, an angle 360 defined by phantom lines 348 and 352 is smaller than angle 350 shown in FIG. 8B. Further, center axis 146 is below point 351 by a distance 364 shorter than distance 354 shown in FIG. 8B. Thus, when belt 32 attached to helmet 20 is tightened using racks 58 and adjuster 44, the vertical distance between belt adjustment device 42 and helmet 20 is reduced by the difference between distances 354 and 364, which allows belt adjustment device 42 to rise up against the occiput of head 16 and better secure helmet 42 on head 16 of user. Further, due at least in part to curvature 59 of racks 58, concaved face 134 of belt adjustment device 42 is tilted up by an angle equivalent to the difference between angles 350 and 360 as belt adjustment device 42 rises up. The tilting of belt adjustment device 42 is depicted in FIGS. 8E through 8F.

Figure 8E:
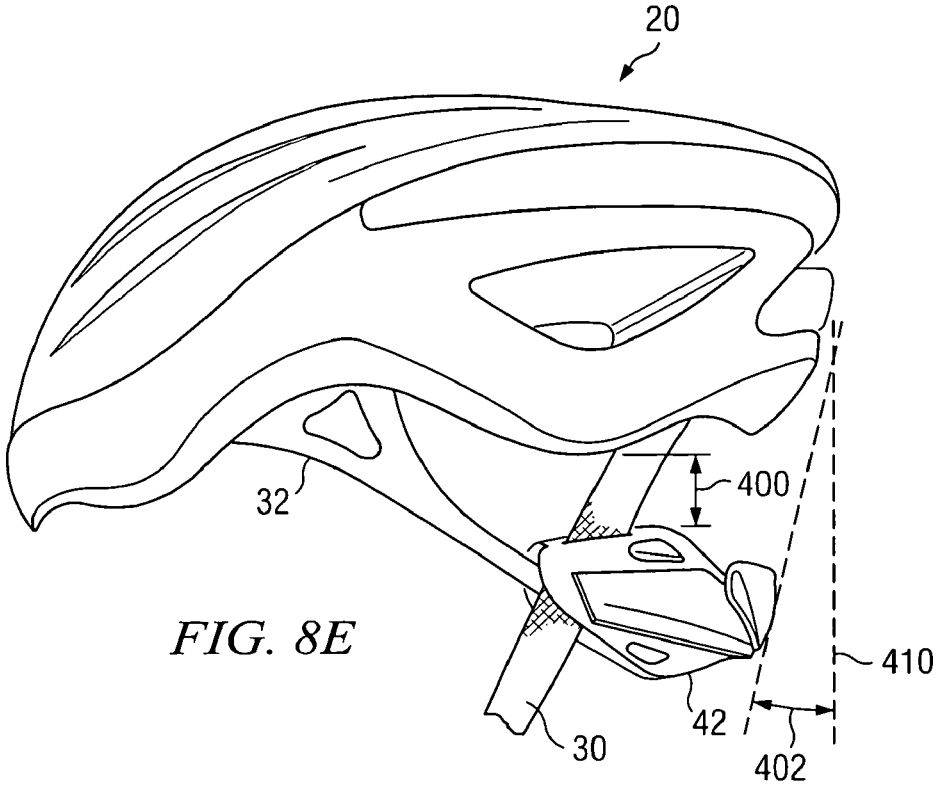
FIGS. 8E-8F are diagrams illustrating a change in orientation of the belt adjustment device resulting from the example operation of the belt adjustment device shown in FIGS. 8B-8D.
Figure 8F:
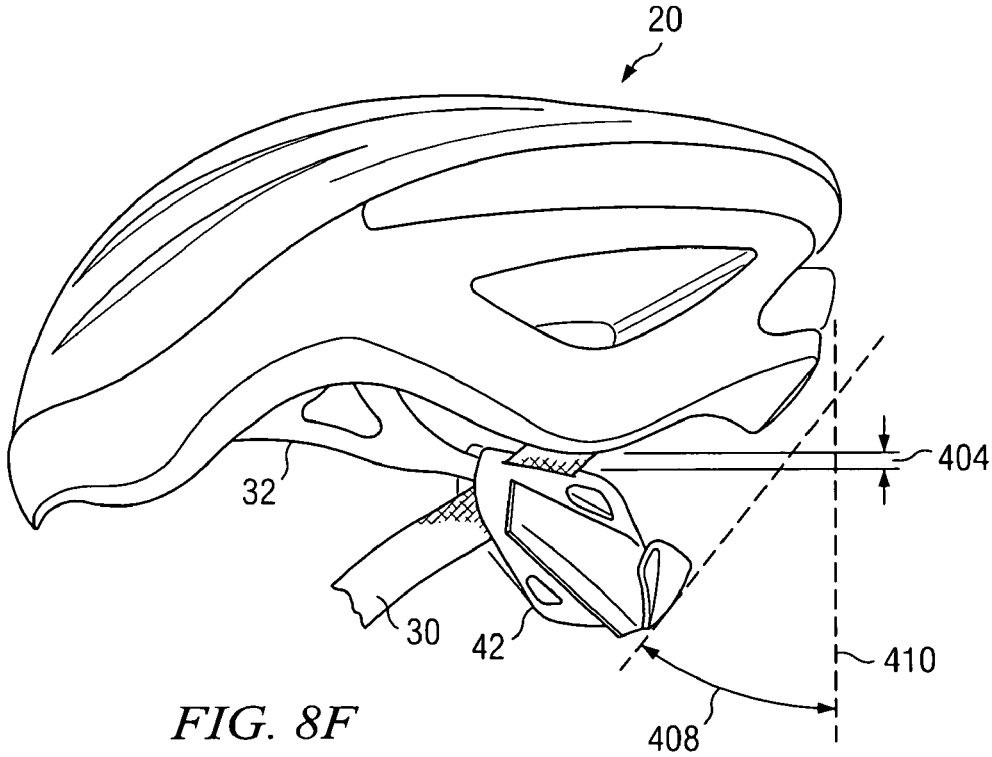

FIG. 8E shows the orientation of belt adjustment device 42 that corresponds to the configuration of end portions 56 shown in FIG. 8B, and FIG. 8F shows the tilted orientation of belt adjustment device 42 that corresponds to the configuration of end portions 56 shown in FIG. 8D. FIGS. 8E and 8F are described jointly. As shown in FIG. 8E, in a loosened configuration, belt adjustment device 42 is below helmet 20 by a distance 400 and tiled at an angle 402 measured from an imaginary vertical line 410. In a tightened configuration shown in FIG. 8F, belt adjustment device 42 is below helmet 20 by a decreased distance 404, where the difference between distances 400 and 404 is equal to the difference between distances 354 and 364 shown in FIGS. 8B and 8E, respectively. Further, belt adjustment device 42 is tilted upward by an angle that is equivalent to the difference between angles 402 and 408 shown in FIGS. 8E and 8F, respectively. In certain embodiments, the difference between angles 402 and 408 is equivalent to the difference between angles 350 and 360 shown in FIGS. 8E and 8F, respectively. Referring back to FIGS. 8D and 8F, in certain embodiments where the radius of curvature 60 of rack 58 is approximately 16 inches and travel distance 346 is approximately 3.15 inches, the difference between angles 350 and 360 is approximately 5.8 degrees, and the difference between distances 354 and 364 is approximately 0.31 inches.

Figure 8G:
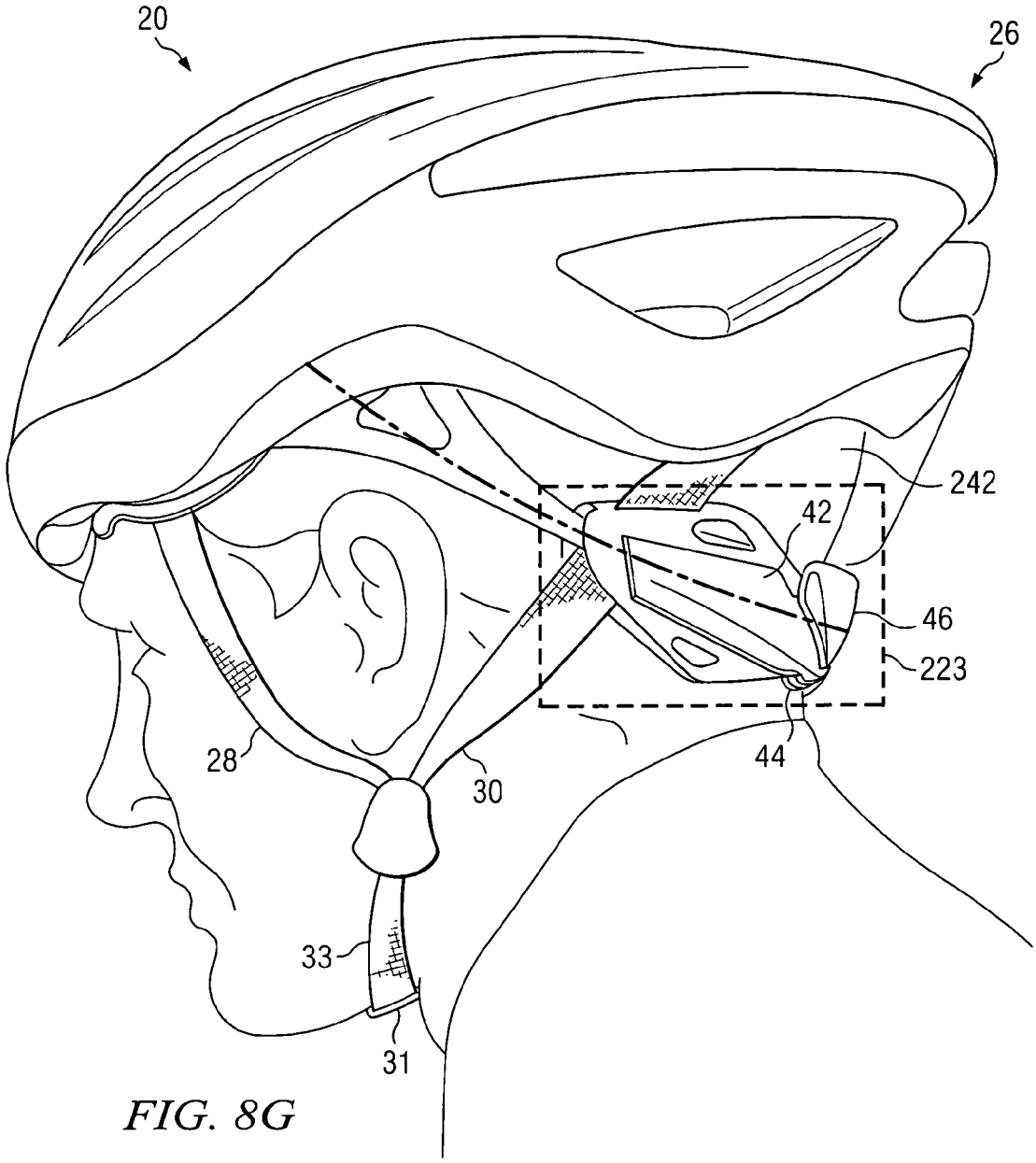
FIG. 8G is a diagram illustrating a perspective view of the rear portion shown in FIG. 8A.

FIG. 8G is a diagram illustrating a perspective view of user 20 wearing helmet 20 having rear portion 223. As shown in FIG. 8G, rear portion's 223 curvature having radius 60 of approximately 16 inches allows helmet 20 to engage an occiput 242 of user's head 16.

Figure 9A:
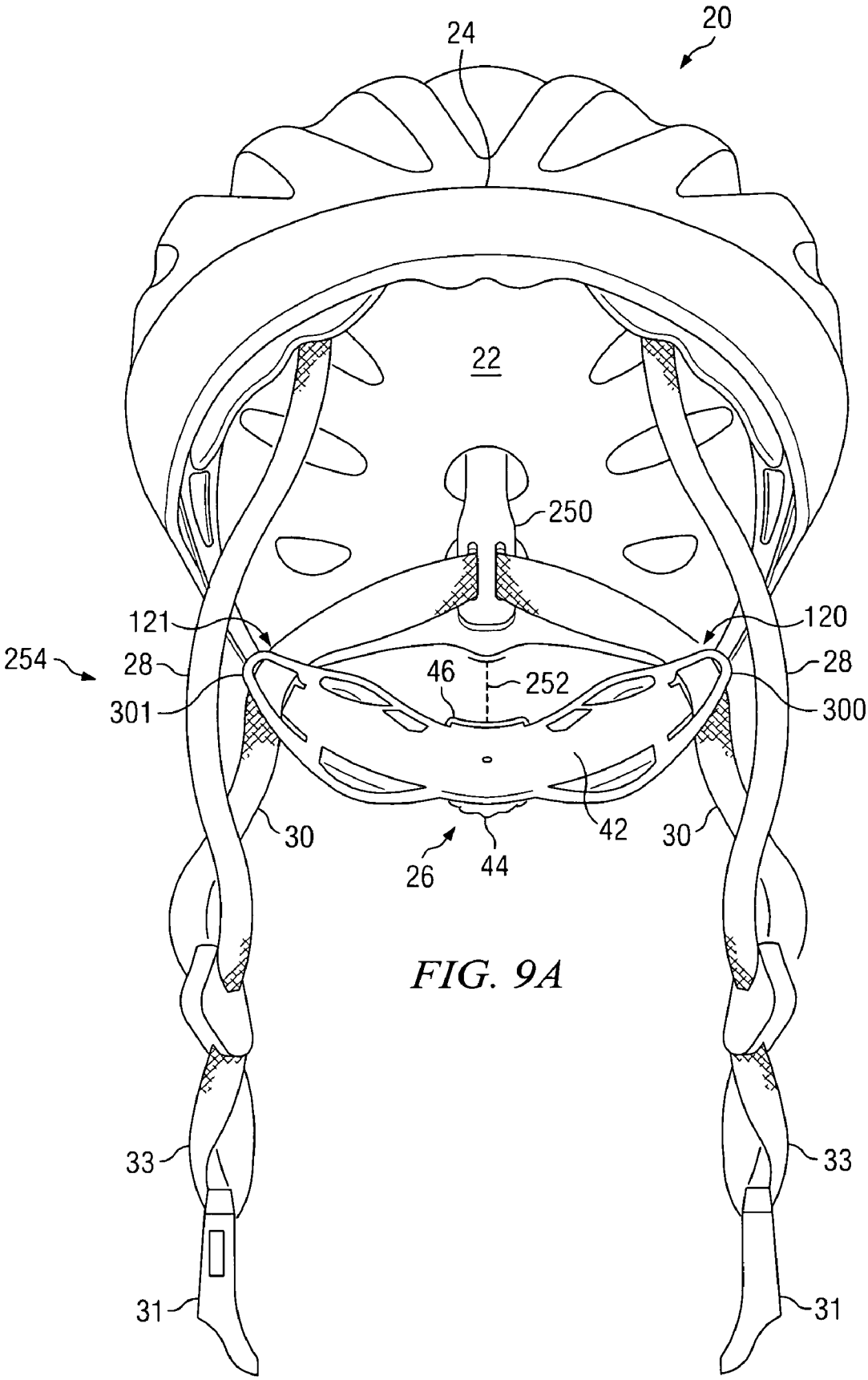
FIG. 9A is a diagram illustrating one embodiment of a strap management system that may be used in conjunction with the helmet shown in FIG. 2.

FIG. 9A is a diagram illustrating one embodiment of a strap management system 254 that may be used in conjunction with helmet 20. Strap management system 254 includes adjustment device 42 having ends 120 and 121 that is operable to slidably secure rear straps 30 apart from each other. In certain embodiments, ends 120 and 121 include loops 300 and 301, respectively. Loops 300 and 301 are used to thread straps 30 so that straps are slidable along the length of straps 30.

Rear straps 30 are coupled to an anchor 250, which is positioned close to rear portion 26 of helmet 20. As shown in FIG. 9A, separating rear straps 30 from each other using adjustment device 42 discourages the tangling of straps 30 and 28. In one embodiment, ends 120 and 121 are flexible (also referred to as flexible ends 120 and 121), which allows movement of straps 30 toward or away from the occiput of head 16. This is advantageous in some embodiments because, as straps 30 are pulled to secure helmet 20 on head 16, straps 30 are allowed to move laterally toward head 16, which allows straps 30 to better follow the contour of head 16 and provide a more customized fit. Additional details describing some embodiments of flexible ends 120 and 121 are provided below in conjunction with FIG. 9C.

In particular embodiments, as shown in FIG. 9A, belt adjustment device 42 is coupled to end portions 56 of belt 32 and rear straps 30, but is not coupled to a portion of helmet 20, as shown by a gap 252. This is advantageous in some embodiments because adjustment device 42 is not included as part of helmet's 20 retention system. A "retention system"

refers to items that are attached to helmet 20 and are used to secure helmet 20 on head 16 of user 12. For example, retention system includes straps 28, 30, 33, and chin buckle 31. Because a retention system of a helmet may be required to comply with certain government standards, excluding adjustment device 42 from the retention system of a helmet 20 allows adjustment device 42 to be designed to optimize the proper fitting, convenience of fitting, and the level of comfort associated with helmet 20 without compromising any of these goals in order to meet certain government standards associated with a retention system.

Figure 9B:
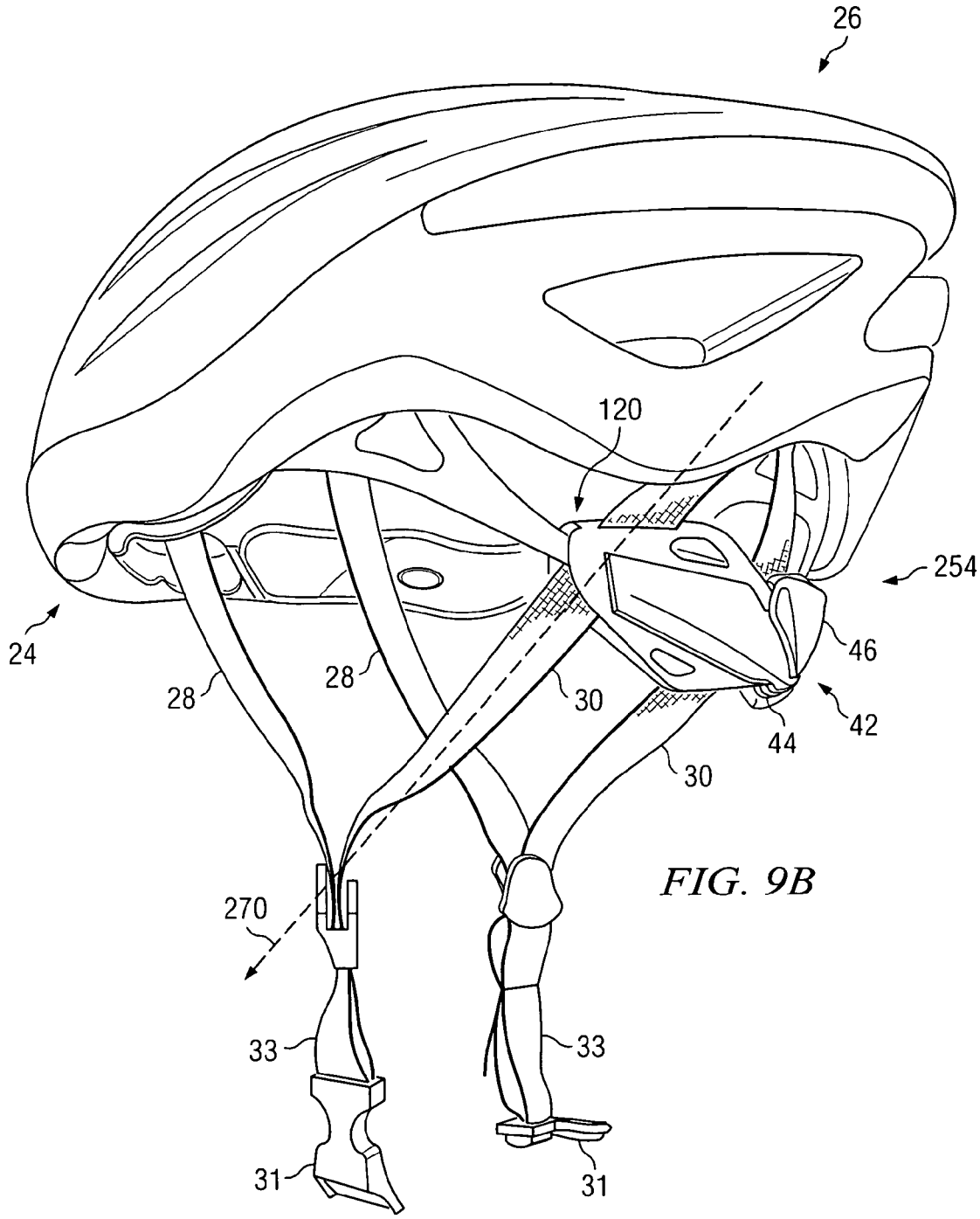
FIG. 9B is a diagram illustrating a perspective view of the strap management system shown in FIG. 9A.

FIG. 9B is a diagram illustrating a perspective view of strap management system 254 shown in FIG. 9A. As shown in FIG. 9B, each rear strap 30 approximately approaches the chin of user 12 along a particular path, which is represented by a phantom line 270. In certain embodiments, ends 120 and 121 are spaced from each far enough so that ends 120 and 121 each intersects a particular path 270 of the secured strap 30. In certain embodiments, as shown in FIG. 6A, straight line distance 122 between ends 120 and 121 is approximately 134.6 mm. This is advantageous in some embodiments because rear strap 30 is not substantially altered from a direct path to the chin of user 12. Such a direct path to the chin of user 12 reduces the amount of slack that may be created between rear 26 of helmet 20 and head 16 in case of impact, which increases the level of protection provided to user 12.

Figure 9C:
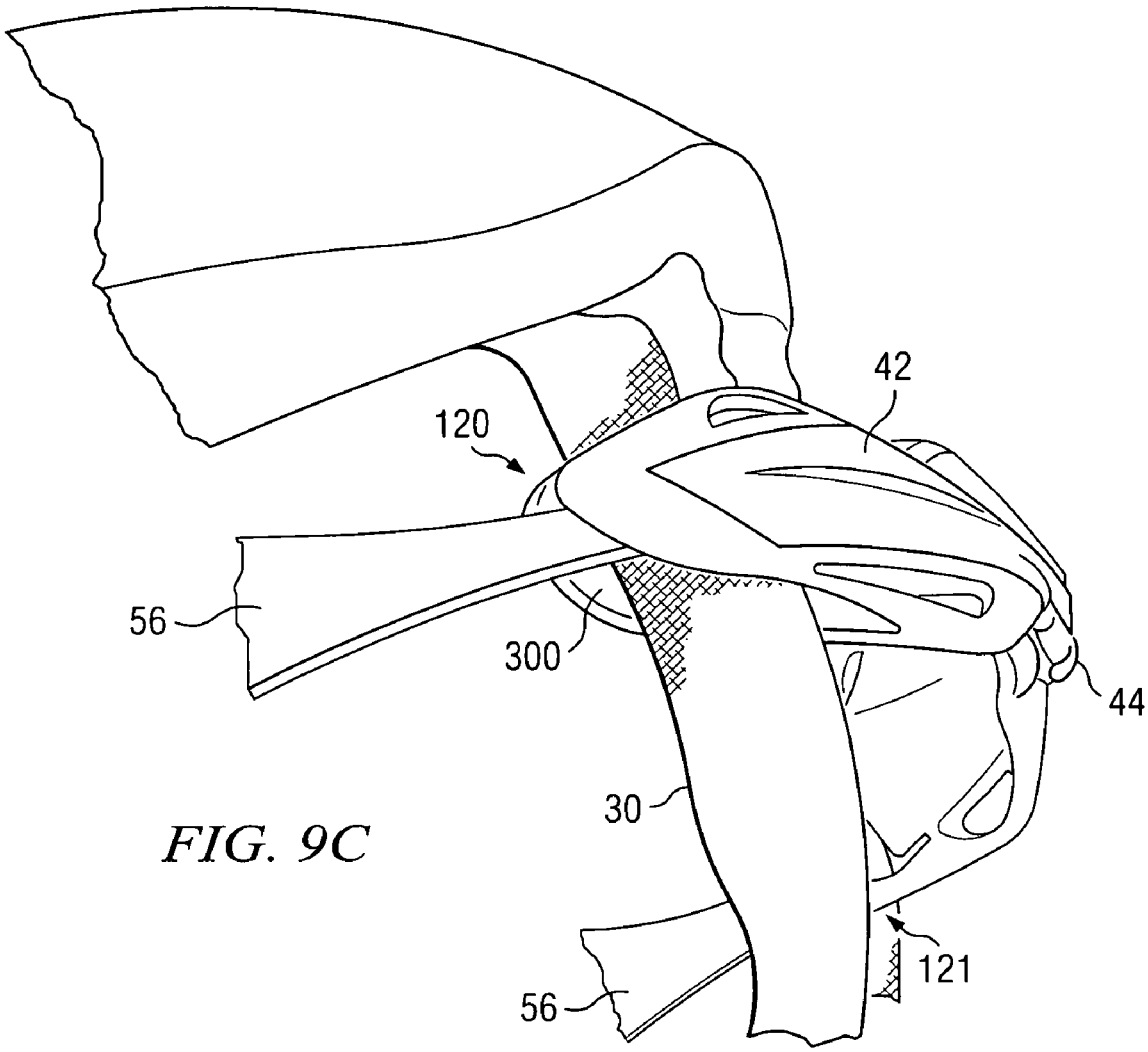
FIG. 9C is a diagram illustrating a flexible end of the belt adjustment device shown in FIG. 9B.

FIG. 9C is a diagram illustrating additional details of one embodiment of end 120. A description that is analogous to the description of end 120 provided below applies to end 121. As shown in FIG. 9C, end 120 includes a retainer 300. Rear strap 30 is slidably restrained by retainer 300. In one embodiment, retainer 300 is flexible, and allows a resisted movement towards or away from head 16 of user 12. Such a movement allows rear straps 30 to better conform to the contour of head 16 of user 12, which provides a more secure and snug fit of helmet 20 on head 16. Ends 120 and 121 that allow movement of straps 30 towards head 16 are referred to as flexible ends 120 and 121. In one embodiment, retainers 300 and 301 are each shaped as a loop, as shown in FIGS. 9C and 9A.

Although some embodiments of the present invention have been described in detail, it should be understood that various changes, substitutions, and alterations can be made hereto without departing from the spirit and scope of the invention as defined by the appended claims.

What is claimed is:

1. An adjustment apparatus for a helmet, the helmet having a belt disposed inside the helmet, the belt having a first end portion and a second end portion that are coupled such that the belt forms a loop, the adjustment apparatus comprising:

a base having a first end and a second end, the base defining a first aperture at a first side and a second aperture at a second side of the base between the first and the second ends;

a channel defined in the base and extending from the first end to the second end, the channel configured to receive the first and the second end portions of the belt at the first end and the second end, respectively;

an adjuster positioned at least partly in the channel and configured to engage both the first and the second end portions of the belt, the adjuster operable to adjust the size of the loop by urging the first and second end portions along the channel in opposite directions, the adjuster at least partly protruding from the second aperture of the base;

a pawl positioned in the base proximate to the adjuster, the pawl operable to engage the adjuster to prevent a movement of the adjuster in at least one direction;

a release actuator coupled to the pawl via the first aperture of the base, the release actuator operable to disengage the pawl from the adjuster; and a hoop spring coupled to the pawl and operable to urge the pawl against the adjuster so that the pawl is engaged with the adjuster.

2. The apparatus of claim 1, wherein the base is coupled to the belt so that the second aperture faces away from the helmet.

3. The apparatus of claim 1, wherein:

the adjuster comprises:

a wheel protruding at least partly out of the first aperture, the wheel having a first side and a second side, the first side defining a cylindrical cavity and a plurality of teeth positioned around the circumference of the cylindrical cavity; and a pinion gear coupled to the second side of the wheel, the pinion gear comprising a plurality of gear teeth formed around a circumference of the pinion gear;

wherein the adjuster is configured to engage both the first and the second end portions of the belt using the plurality of gear teeth of the pinion gear.

4. The apparatus of claim 1, wherein the first end and the second end are separated from each other by a distance of between approximately 130 and 140 millimeters.

5. The apparatus of claim 1, wherein a row of gear teeth having a first side and a second side opposite from the first side, the first side not directly attached to any supporting structure, wherein the gear teeth form a curvature towards a top portion of the helmet having a radius of curvature of approximately 14-18 inches; and a flange positioned along the second side of the row of gear teeth to structurally support the gear teeth.

6. The apparatus of claim 5, wherein the belt, the row of gear teeth, and the flange are formed from a same material.

7. The apparatus of claim 6, wherein the same material is low density polyethylene.

8. The apparatus of claim 5, wherein the radius of curvature ef is approximately 16 inches.

9. The apparatus of claim 5, and further comprising an L-shaped flange coupling each end portion and the row of gear teeth.

10. The apparatus of claim 1, wherein the first and the second end portions the belt, when at least partly overlapped, define a curvature towards a top portion of the helmet having a radius of curvature of approximately 14 to 18 inches.

11. The apparatus of claim 10, wherein the radius is approximately 16 inches.

12. The apparatus of claim 10, wherein the first and the second end portions comprise a first row of teeth and a second row of teeth, respectively, and the curvature is defined by the first and the second rows of teeth.

13. The apparatus of claim 12, wherein each of the first and the second end portions comprises:

a row of gear teeth having a first side and a second side opposite from the first side, the first side not directly attached to any supporting structure; and a flange positioned along the second side of the row of gear teeth to structurally support the gear teeth.

14. The apparatus of claim 1, wherein the first end of the base slidably engages the a first strap secured to an anchor attached to a rear portion of the helmet and the second end slidably engages a second strap secured to the anchor such that the base is able to slide with respect to the length of the first and second straps.

15. The apparatus of claim 14, wherein the first and the second ends are flexible.

16. The apparatus of claim 14, wherein the base is indirectly coupled to the helmet by only the belt, the first strap, and the second strap.

17. The apparatus of claim 14, wherein the base comprises a face that approximates a curvature of an occiput of a user.

18. The apparatus of claim 1, wherein the channel defines a curvature towards a top portion of the helmet having a radius of curvature of approximately 14-18 inches.

19. The apparatus of claim 1, wherein the channel defines a curvature towards a top portion of the helmet having a radius of curvature of approximately 16 inches.

20. The apparatus of claim 1, wherein the adjuster and the release actuator are respectively positioned on opposite sides of the base and between the first and the second ends of the base.

21. The apparatus of claim 1, wherein the base comprises a face that approximates a contour of an occiput of a user.

22. The apparatus of claim 1, wherein the first end and the second end of the base each comprises a flexible loop operable to receive a strap having a length and to allow the length of the strap to slide with respect to the base.

23. A system for fitting a helmet on a head of a user, the helmet having a first strap and a second strap anchored at a rear portion of the helmet, the system comprising:

a belt disposed at least partly in an interior of the helmet, the belt having a first curved rack gear and a second curved rack gear that extend toward the rear portion of the helmet, each of the first and the second curved rack gears having a side that is attached to a curved flange and a radius of curvature of approximately 16 inches, the belt defining a first hole and a second hole;

a rib positioned across the first hole;

a button suspended over the second hole by a pair of collapsible legs coupling the button and the belt, the button having a footprint that fits within the second hole;

a belt adjustment mechanism not directly attached to the helmet, the belt adjustment mechanism comprising:

a pinion gear engaged with the first and the second curved rack gears of the belt;

a wheel gear coaxially attached to the pinion gear;

a ratchet engaged with the wheel gear;

a release actuator coupled to the ratchet and positioned in a location separate from the wheel gear;

a first end slidably coupled to the first strap; and a second end positioned approximately 135 millimeters from the first end and slidably coupled to the second strap;

wherein the wheel gear is operable to incrementally urge the first and the second curved rack gears in opposite directions using the pinion gear by turning in a first direction, the ratchet is operable to prevent the wheel gear from turning in a second direction that is opposite from the first direction, and the release actuator is operable to disengage the ratchet from the wheel; and a pad defining a button hole, an compressed arcuated strip and a compressed strip having an approximately same orientation and width as the rib, the pad coupled to the button of the belt at the button hole and woven through the first hole and the rib, wherein the compressed strip of the pad underlies the rib, and the compressed arcuated strip is disposed approximately along the length of the pad.

* * * * *